US010531779B2

(12) United States Patent
Machida et al.

(10) Patent No.: US 10,531,779 B2
(45) Date of Patent: Jan. 14, 2020

(54) ELECTRIC VACUUM CLEANING APPARATUS

(71) Applicant: Toshiba Lifestyle Products & Services Corporation, Kawasaki-shi (JP)

(72) Inventors: Yukio Machida, Owariasahi (JP); Masatoshi Tanaka, Seto (JP); Satoshi Ohshita, Owariasahi (JP); Hiromitsu Ichikawa, Owariasahi (JP); Tsuyoshi Sato, Owariasahi (JP)

(73) Assignee: Toshiba Lifestyle Products & Services Corporation, Kawasaki-shi (JP)

( * ) Notice: Subject to any disclaimer, the term of this patent is extended or adjusted under 35 U.S.C. 154(b) by 333 days.

(21) Appl. No.: 15/400,039

(22) Filed: Jan. 6, 2017

(65) Prior Publication Data

US 2017/0196430 A1 Jul. 13, 2017

(30) Foreign Application Priority Data

Jan. 12, 2016 (JP) ..... 2016-003206

(51) Int. Cl.
*A47L 9/28* (2006.01)
*A47L 9/16* (2006.01)

(52) U.S. Cl.
CPC ..... *A47L 9/2873* (2013.01); *A47L 9/1683* (2013.01); *A47L 2201/022* (2013.01); *A47L 2201/024* (2013.01); *A47L 2201/04* (2013.01)

(58) Field of Classification Search
CPC ..... A47L 2201/02; A47L 2201/024; A47L 5/225; A47L 9/2873; A47L 2201/022
See application file for complete search history.

(56) References Cited

U.S. PATENT DOCUMENTS 8,635,739 B2 * 1/2014 Lee ..... A47L 9/20 15/319
2007/0157415 A1 * 7/2007 Lee ..... A47L 5/225 15/319

(Continued)

FOREIGN PATENT DOCUMENTS

DE 10 2010 000 607 A1 9/2011
DE 10 2010 016 283 A1 10/2011

(Continued)

OTHER PUBLICATIONS

Internet Publication, ESI Technologies Group, Valve Actuators, https://esitechgroup.com/product/valves-actuation/actuators/ (Year: 2018).*

*Primary Examiner* — Bryan R Muller
(74) *Attorney, Agent, or Firm* — Oblon, McClelland, Maier & Neustadt, L.L.P.

(57) ABSTRACT

An electric vacuum cleaning apparatus that offers a high degree of convenience is provided that is capable of easily switching between a function that empties dust from an electric vacuum cleaner by moving dust collected by the cleaner to a station and accumulating the dust at the station, and a function that accumulates dust that is swept up together after quickly performing localized cleaning using an cleaning implement other than the cleaner at the station. An electric vacuum cleaning apparatus 1 includes: a dust transfer pipe 22 that is connected to an autonomous robotic vacuum cleaner 2, and that sucks in dust collected by the cleaner 2; a suction passage 61 that sucks in other dust that is different to dust collected by the cleaner 2; a secondary dust container 28 that is connected to the pipe 22 and the suction passage 61; an electric blower 29 that applies a negative pressure to the pipe 22 and the suction passage 61; and a switching valve unit 72 that is capable of switching a channel that is connected to the dust container 28 so as to (Continued)

allow either one of, and block the other of, flowing between the pipe 22 and the dust container 28 and flowing between the suction passage 61 and the dust container 28.

15 Claims, 15 Drawing Sheets

(56) References Cited

U.S. PATENT DOCUMENTS

| | | | | |
|---|---|---|---|---|
| 2009/0049640 | A1 | 2/2009 | Lee et al. | |
| 2016/0183752 | A1 * | 6/2016 | Morin | A47L 9/14 134/18 |

FOREIGN PATENT DOCUMENTS

| | | | | |
|---|---|---|---|---|
| DE | 102010016263 | A1 * | 10/2011 | A47L 9/106 |
| EP | 3033982 | A1 * | 6/2016 | A47L 9/149 |
| JP | 10-075918 | A | 3/1998 | |
| JP | 10-155707 | A | 6/1998 | |
| JP | 2001-056067 | A | 2/2001 | |
| JP | 2007-181656 | A | 7/2007 | |
| WO | WO 2007/137234 | A2 | 11/2007 | |

* cited by examiner

ELECTRIC VACUUM CLEANING APPARATUS

CROSS-REFERENCE TO RELATED APPLICATIONS

This application claims the benefit of priority of Japanese Patent Application No. 2016-003206, filed on Jan. 12, 2016, the entire contents of which are incorporated herein by reference.

FIELD

An embodiment according to the present invention relates to an electric vacuum cleaning apparatus.

BACKGROUND

An electric vacuum cleaning apparatus is known that sucks in and accumulates dust that was swept up together with a cleaning implement such as a mop, a broom or a floor cleaning implement.

Patent Document 1: Japanese Patent Laid-Open No. 2012-245318

SUMMARY OF THE INVENTION

Non-autonomous electric vacuum cleaners that the users themselves operate, such as a canister-type vacuum cleaner, and autonomous electric vacuum cleaners that are so-called "robot cleaners" that may autonomously perform cleaning during a period in which the user is away from home are known. While these electric vacuum cleaners can provide a high degree of convenience when used to clean an area that is wide to a certain extent, such as an entire living room, the convenience inevitably decreases when the electric vacuum cleaners are used to clean a narrow area, for example, when cleaning up bits of confectionery that were spilled by a child while eating, that is, when used for a use such as instantly cleaning one part of a living room.

For a use such as simply cleaning a narrow area, in comparison to using an electric vacuum cleaner, the cleaning can be performed more quickly by sweeping up the dust using a cleaning implement other than an electric vacuum cleaner, for example, a mop, a broom or a floor cleaning implement.

However, even in the case of sweeping up dust using the cleaning implement other than an electric vacuum cleaner, in order to dispose of the dust after the dust has been swept up, time and labor is additionally required to dispose of the dust using a dustpan.

To solve the problems described above, it is an object of the present invention to provide an electric vacuum cleaning apparatus that is capable of easily disposing of dust that has been collected after performing localized cleaning quickly using the cleaning implement other than an electric vacuum cleaner with effectively utilizing a station that is placed in a living room.

It is an object of the present invention also to provide an electric vacuum cleaning apparatus that has a high degree of convenience that is capable of easily switching between a function that moves dust collected by an electric vacuum cleaner to a station and accumulates the dust at the station to thereby empty the electric vacuum cleaner, and a function that accumulates dust that was swept up at the station after quickly performing localized cleaning using the cleaning implement other than an electric vacuum cleaner.

To achieve the above object, an aspect of the present invention provides an electric vacuum cleaning apparatus comprising: an electric vacuum cleaner that collects dust on a surface to be cleaned; and a station to which the electric vacuum cleaner can be mounted; wherein the station includes a first suction channel that is connected to the electric vacuum cleaner in a state in which the electric vacuum cleaner returned to the station, and which sucks in dust collected by the electric vacuum cleaner, a second suction channel that sucks in other dust that is different to dust collected by the electric vacuum cleaner, a dust container that is fluidly connected to the first suction channel and the second suction channel, and that accumulates dust that flows in from the first suction channel and the second suction channel, an electric blower that applies a negative pressure to the first suction channel and the second suction channel through the dust container, and a switching valve unit that is capable of switching a channel that is connected to the dust container so as to allow either one of, and block another of, flowing between the first suction channel and the dust container and flowing between the second suction channel and the dust container.

In preferred embodiments of the above aspect, the following modes may be provided.

It may be desired that the switching valve unit separately and independently includes: a first switching valve having a first valve member that is capable of allowing or blocking flowing through the first suction channel, and a first hinge that supports the first valve member, and a second switching valve having a second valve member that is capable of allowing or blocking flowing through the second suction channel, and a second hinge that supports the second valve member.

It may be desired that the switching valve unit integrally includes a first valve member that is capable of allowing or blocking flowing through the first suction channel and a second valve member that is capable of allowing or blocking flowing through the second suction channel, and a hinge that collectively supports the first valve member and the second valve member.

It may be further desired that a valve switching mechanism that is capable of switching the switching valve unit by a one-time operation.

It may be desired that the valve switching mechanism includes a slider that generates a driving force that opens and closes the switching valve unit by means of a reciprocating motion.

It may be desired that the valve switching mechanism includes a scotch yoke that includes a guide slot that is provided in the slider, and an eccentric pin that is provided in the switching valve unit eccentrically with respect to a hinge of the switching valve unit, and is arranged in the guide slot.

It may be further desired that a power source that causes a force to act on the slider so as to actuate the switching valve unit to enter a state in which the switching valve unit blocks flowing between the first suction channel and the dust container and allows flowing between the second suction channel and the dust container.

It may be further desired that a clutch that holds the switching valve unit in a state in which the switching valve unit allows flowing between the first suction channel and the dust container and blocks flowing between the second suction channel and the dust container, and that temporarily restricts movement of the slider.

It may be further desired that a push button for an operation that interlocks with the slider.

It may be desired that a state where the push button is pressed down is a state where flowing through the first suction channel is allowed and flowing through the second suction channel is blocked, and a state where the push button is not pressed down is a state where flowing through the first suction channel is blocked and flowing through the second suction channel is allowed.

It may be further desired that a case having a hole that exposes the push button, wherein an amount by which the push button protrudes from the case is greater in a state in which the push button is not pressed down than in a state in which the push button is pressed down.

It may be desired that the push button includes a sign that is exposed to outside the case and is visually recognizable in a state in which the push button is not pressed down.

It may be desired that the switching valve unit opens by means of a self-weight of a valve member.

It may be further desired that an elastic pressing mechanism that generates a force that presses the valve member against a valve seat in a state in which the switching valve unit blocks flowing between the channel and the dust container.

It may be further desired that a detector that drives the electric blower when flowing between the first suction channel and the dust container is blocked and flowing between the second suction channel and the dust container is allowed.

It may be desired that the detector that detects that flowing between the first suction channel and the dust container is blocked and flowing between the second suction channel and the dust container is allowed based on a position of the slider.

It may be desired that the first valve member is arranged in the first suction channel, and the second valve member is arranged in the second suction channel.

It may be further desired that a first recess that is provided in the first suction channel and in which the first valve member is accommodated in a state that allows flowing between the first suction channel and the dust container, and a second recess that is provided in the second suction channel and in which the second valve member is accommodated in a state that allows flowing between the second suction channel and the dust container.

DETAILED DESCRIPTION OF THE PREFERRED EMBODIMENTS

Figure 1:
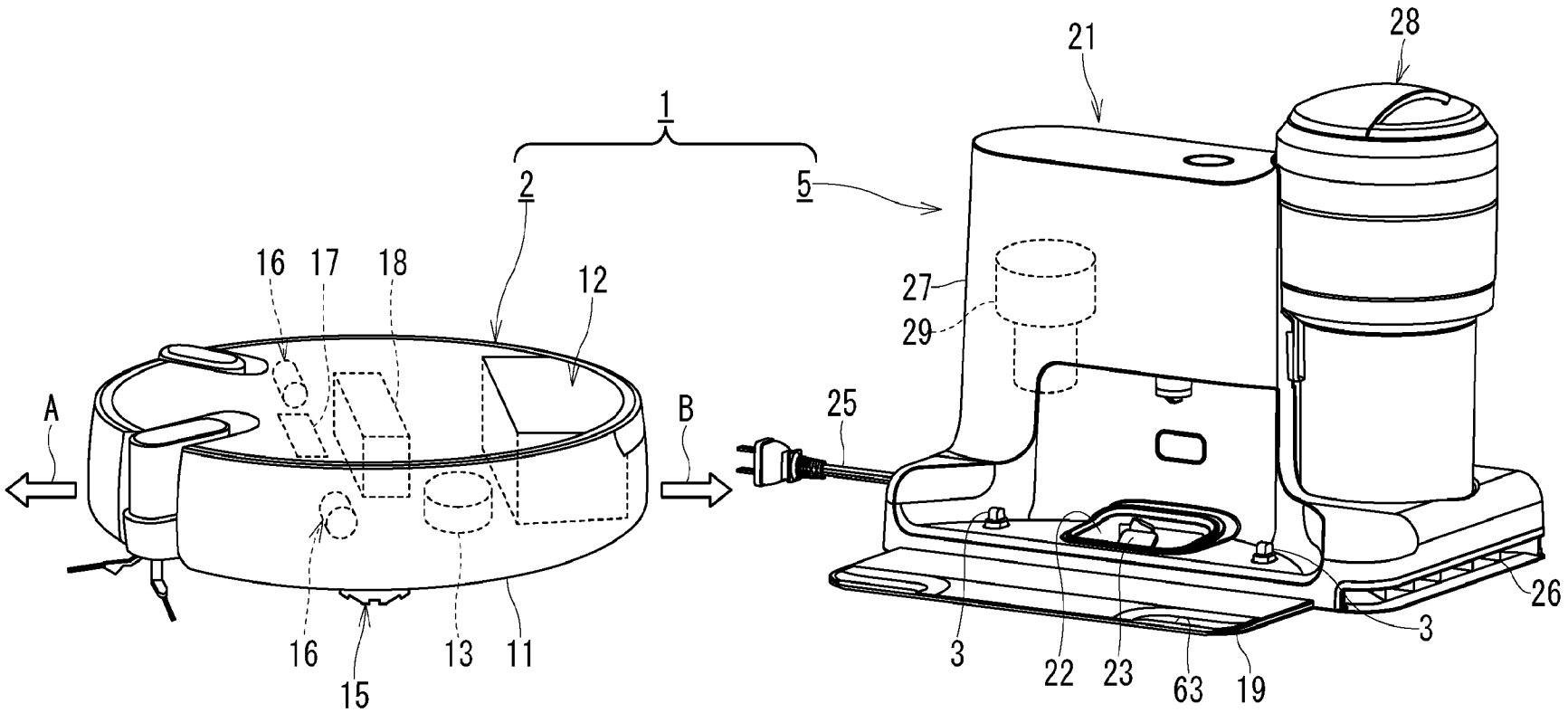
FIG. 1 is a perspective view illustrating the external appearance of an electric vacuum cleaning apparatus according to an embodiment of the present invention.

An embodiment of an electric vacuum cleaning apparatus according to the present invention will be described with referring to FIG. 1 to FIG. 16. Note that components that are identical or equivalent to each other in a plurality of drawings are denoted by the same reference characters.

FIG. 1 is a perspective view that illustrates the external appearance of an electric vacuum cleaning apparatus as one example according to an embodiment of the present invention.

As illustrated in FIG. 1, an electric vacuum cleaning apparatus 1 according to the present embodiment includes an autonomous robotic vacuum cleaner 2 that autonomously moves over a surface to be cleaned, for example, a floor to collect dust on the surface, and a station 5 that includes charging electrodes 3 for charging the autonomous robotic vacuum cleaner 2. The autonomous robotic vacuum cleaner 2 autonomously moves across the entire area of the surface within a living room to collect dust, and thereafter homes or returns to the station 5. The station 5 takes out and accumulates the dust collected by the autonomous robotic vacuum cleaner 2 that homed thereto.

The electric vacuum cleaning apparatus 1 can also directly suck up dust, which is swept up together using a cleaning implement other than the autonomous robotic vacuum cleaner 2, for example, a cleaning implement such as a mop, a broom or a floor cleaning implement, and dust that adheres to the cleaning implement at the station 5.

Note that, a position where the autonomous robotic vacuum cleaner 2 is electrically connected to the charging electrodes 3 of the station 5 is a home position of the autonomous robotic vacuum cleaner 2 that homes or returns to the station 5. The autonomous robotic vacuum cleaner 2 homes to the home position when charging is required or when cleaning up the surface of the living room is finished. The position where the autonomous robotic vacuum cleaner 2 is electrically connected to the charging electrodes 3 of the station 5 is determined by the relative position between the autonomous robotic vacuum cleaner 2 that autonomously moves and the station 5 that can be arbitrary placed.

In FIG. 1, an arrow A represents an advancing direction of the autonomous robotic vacuum cleaner 2, and an arrow B represents a retreating direction of the autonomous robotic vacuum cleaner 2. The width direction of the autonomous robotic vacuum cleaner 2 is a direction that is orthogonal to the arrow A and arrow B.

The autonomous robotic vacuum cleaner 2 advances to separate from the station 5 and autonomously travels around the inside of the living room. Subsequently, when homing to the station 5, the autonomous robotic vacuum cleaner 2 retreats to be connected to the station 5.

The autonomous robotic vacuum cleaner 2 is a so-called "robot cleaner". The autonomous robotic vacuum cleaner 2 autonomously moves over the surface to collect dust. The autonomous robotic vacuum cleaner 2 includes a hollow first body case 11, a primary dust container 12 that is detachably provided at a rear part of the first body case 11, a primary electric blower 13 that is housed inside the first body case 11 and is connected to the primary dust container 12, a running gear 15 that causes the autonomous robotic vacuum cleaner 2 to travel over the surface, a driving force source 16 that drives the running gear 15, a robot controller 17 that controls the driving force source 16 to cause the first body case 11 to autonomously travel over the surface, and a rechargeable battery 18 as a power source.

The station 5 is placed at an arbitrary location on the surface. That is, the surface, which is be cleaned by the autonomous robotic vacuum cleaner 2, is also the installation surface for the station 5. The station 5 includes a base part 19 that the autonomous robotic vacuum cleaner 2 runs onto when homing to the position (home position) at which the autonomous robotic vacuum cleaner 2 is electrically connected to the charging electrodes 3, a dust collector 21 that is integrated with the base part 19, a dust transfer pipe 22 that is airtightly connected to the primary dust container 12 of the autonomous robotic vacuum cleaner 2 in the position (home position) where the autonomous robotic vacuum cleaner 2 is electrically connected to the charging electrodes 3, a lever 23 that protrudes from inside the dust transfer pipe 22; and a power cord 25 that delivers electric power from a commercial alternating current power source.

The dust collector 21 includes a second body case 27 having a second intake port 26 that sucks in other dust that is different from dust collected by the autonomous robotic vacuum cleaner 2, a secondary dust container 28 that accumulates dust that is discarded from the primary dust container 12 through the dust transfer pipe 22; and a secondary electric blower 29 that is housed inside the second body case 27 and is connected to the secondary dust container 28.

As well as being connected to the dust transfer pipe 22, the secondary dust container 28 is also connected to the second intake port 26. The station 5 causes a suction negative pressure that is generated by the secondary electric blower 29 to act at the second intake port 26 through the secondary dust container 28. By means of the negative pressure acting at the second intake port 26, the station 5 directly sucks up dust that is swept up together with the cleaning implement as well as dust that adheres to the cleaning implement.

Next, the autonomous robotic vacuum cleaner 2 according to the embodiment of the present invention is described in detail.

Figure 2:
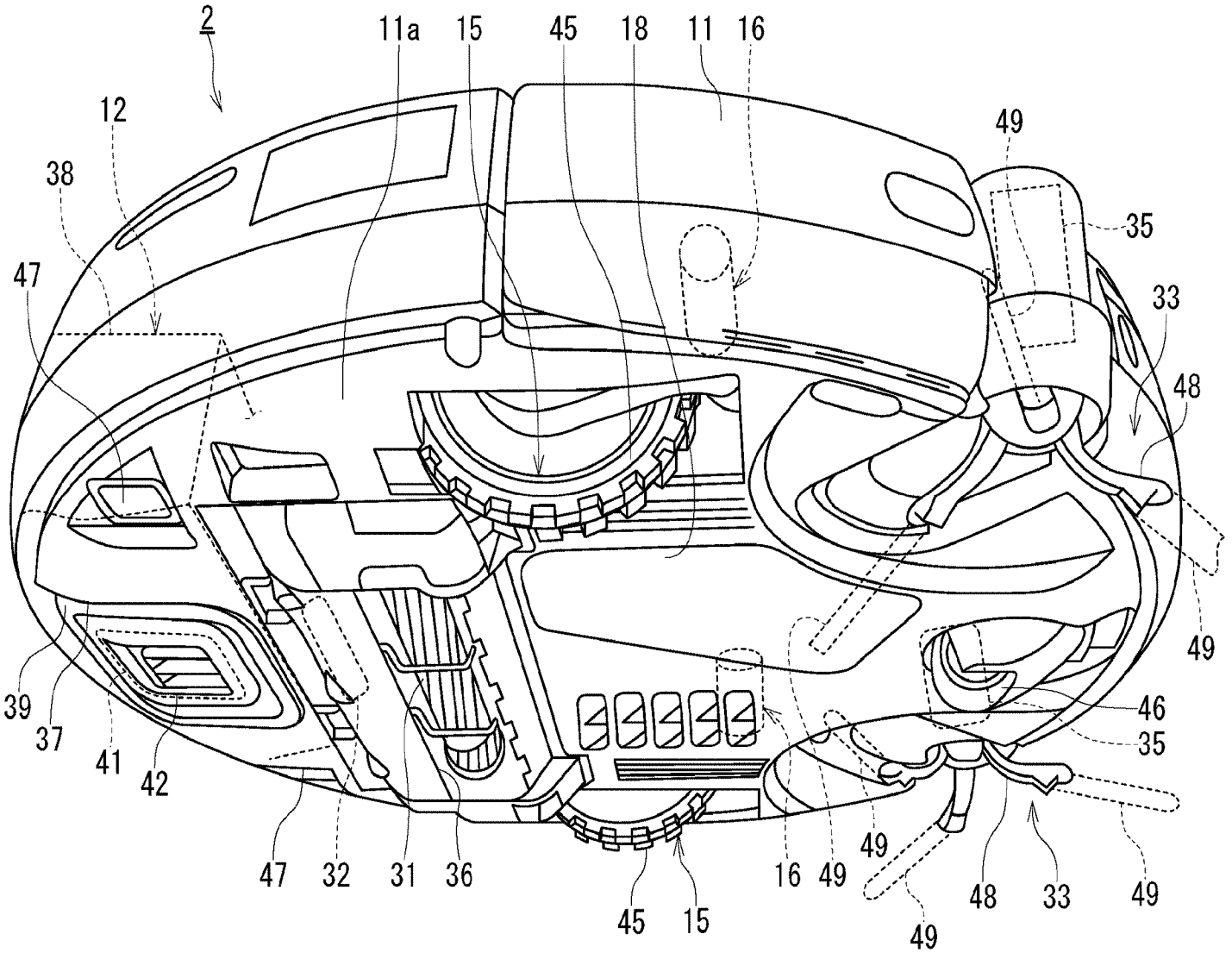
FIG. 2 is a perspective view illustrating an undersurface of an autonomous robotic vacuum cleaner of the electric vacuum cleaning apparatus according to the embodiment of the present invention.

FIG. 2 is a perspective view illustrating the undersurface of an autonomous robotic vacuum cleaner of the electric vacuum cleaning apparatus according to the embodiment of the present invention.

As illustrated in FIG. 2, the autonomous robotic vacuum cleaner 2 of the electric vacuum cleaning apparatus 1 according to the embodiment of the present invention includes a rotating brush 31 that is provided on an undersurface 11*a* of first body case 11, a rotating brush driving force source 32 that drives the rotating brush 31; a left and right pair of spinning side brushes 33 provided on the undersurface 11*a* of the first body case 11; and a left and right pair of spinning-side-brush driving force sources 35 that respectively drive the spinning side brushes 33.

The first body case 11 is made of, for example, a synthetic resin, and can easily rotate over the surface. A first intake port 36 that is horizontally long is provided at a center portion in the width direction in a rear-half portion of the undersurface 11*a*.

A width dimension of the first intake port 36 is approximately two-thirds of a width dimension of the first body case 11. The first intake port 36 is fluidly connected to the primary electric blower 13 via the primary dust container 12.

The first body case 11 has a dust container opening 37 in the undersurface 11*a*. The dust container opening 37 is arranged at a portion that is further to the rear than the first intake port 36, and that covers a lower part of the primary dust container 12. The dust container opening 37 opens in a rectangular shape with rounded corners, and partially exposes the primary dust container 12 mounted in the first body case 11.

The primary dust container 12 accumulates dust that is sucked in from the first intake port 36 by the suction negative pressure that the primary electric blower 13 generates. A filter that filters and collects dust from air, or a separation apparatus that separates and accumulates dust from air by inertial separation such as centrifugal separation (cyclone separation) or separation by difference of inertia force between dust and air in a straight advance direction is applied to the primary dust container 12. The primary dust container 12 is arranged at a position further to the rear than the first intake port 36 and a position at the rear part of the first body case 11. The primary dust container 12 includes a container body 38 that is detachably provided in the first body case 11 to accumulate dust collected by the autonomous robotic vacuum cleaner 2, a attaching part 39 that is exposed from the dust container opening 37 in a state where it is attached to the first body case 11; a disposal port 41 that is provided in the attaching part 39 and is used to discard dust contained inside the container body 38; and a disposal lid 42 that opens and closes the disposal port 41.

The running gear 15 includes a left and right pair of driving wheels 45 that are arranged on the undersurface 11*a* of the first body case 11, and a caster 46 that is arranged on the undersurface 11*a* of the first body case 11.

The pair of driving wheels 45 protrude from the undersurface 11*a* of the first body case 11, and are grounded on the surface in a state where the autonomous robotic vacuum cleaner 2 is placed on the surface. The pair of driving wheels 45 are arranged at approximately a center portion in the longitudinal direction of the first body case 11, and are respectively arranged closer the left and right side portions of the first body case 11 in a manner that avoids the front of the first intake port 36. Axles of driving wheels 45 align in the width direction of the first body case 11. The autonomous robotic vacuum cleaner 2 advances or retreats by causing the left and right driving wheels 45 to respectively rotate in the same direction as each other, and rotates or turns in the right direction or left direction by causing the left and right driving wheels 45 to rotate in opposite directions to each other.

The caster 46 is a driven wheel that is rotatable. The caster 46 is arranged at a position that is at approximately a center portion in the width direction of the first body case 11 and is at a front part thereof.

The driving force source 16 includes a pair of electric motors that are respectively connected to the corresponding driving wheels 45. The driving force source 16 independently drives each of the left and right driving wheels 45.

The robot controller 17 includes a microprocessor (not illustrated in the drawings) and a storage apparatus (not illustrated in the drawings) that stores various arithmetic programs that the microprocessor executes as well as parameters, for example. The robot controller 17 is electrically connected to the primary electric blower 13, the driving force source 16, the rotating brush driving force source 32 and the spinning-side-brush driving force sources 35.

The rechargeable battery 18 is a power source for the primary electric blower 13, the rotating brush driving force source 32, the driving force source 16, the spinning-side-brush driving force sources 35 and the robot controller 17. The rechargeable battery 18 is arranged, for example, between the caster 46 and the first intake port 36. The rechargeable battery 18 is electrically connected to a pair of charging terminals 47 arranged on the undersurface 11*a* of the first body case 11. The rechargeable battery 18 is charged when the charging terminals 47 is connected to the charging electrodes 3 of the station 5.

The rotating brush 31 is provided in the first intake port 36. The rotating brush 31 rotates around a rotational central line that extends in the width direction of the first body case 11. The rotating brush 31 may include a lengthy shaft portion (not illustrated in the drawings), and a plurality of brush strips (not illustrated in the drawings) that extend in a radial direction of the shaft portion and are arranged side by side in a spiral shape in the longitudinal direction of the shaft portion. The rotating brush 31 protrudes downward relative to the undersurface 11*a* of the first body case 11 from the first intake port 36. The brushes of the rotating brush 31 are caused to contact the surface in a state where the autonomous robotic vacuum cleaner 2 is placed on the surface.

The rotating brush driving force source 32 is housed inside the first body case 11.

The spinning side brushes 33 are auxiliary cleaning elements. The spinning side brushes 33 are arranged at side portions on the corresponding left and right at the front part of the undersurface 11*a* of the first body case 11 in a manner that avoids the front (direct front) of the rotating brush 31. The pair of spinning side brushes 33 sweeps up together dust on the surface beside walls, which the rotating brush 31 does not reach, and guide the dust to the first intake port 36. Each of the spinning side brushes 33 includes a brush base 48 having a center of rotation that tilts forward somewhat relative to the normal of the surface to be cleaned, and, for example, three linear brushes 49 that radially protrude toward the radial direction of the brush base 48.

The left and right brush bases 48 are arranged at positions that are further to the front than the first intake port 36 and the left and right driving wheels 45 and further to the rear than the caster 46, and are closer to the corresponding left and right sides of the first body case 11 than the first intake port 36. The rotational central line of each of the brush bases 48 is tilted forward somewhat relative to the normal of the surface. Consequently, the linear brushes 49 turn along a plane that is tilted forward relative to the surface. When the linear brush 49 turns around by itself and a distal end of the linear brush 49 comes in front of the brush base 48, the distal end is pressed the most firmly onto the surface, whereas the distal end of the linear brush 49 is farthest from the surface when it comes to right behind of the brush base 48.

The plurality of linear brushes 49 are arranged at even intervals in, for example, three directions in a radial shape from the brush bases 48. Note that, the spinning side brushes 33 may include four or more of the linear brushes 49 for each of the brush bases 48. The respective linear brushes 49 include a plurality of brush bristles as cleaning members on the distal end. The brush bristles turn in a manner that draws a locus that expands further to the outer side than the outer circumferential edge of the first body case 11.

Each of the spinning-side-brush driving force sources 35 includes a rotating shaft (not illustrated in the drawings) that protrudes downward to be connected to the brush base 48 of the corresponding spinning side brush 33. Each of the spinning-side-brush driving force sources 35 causes the corresponding spinning side brush 33 to rotate so as to sweep up together dust from the surface into the first intake port 36.

Next, the station 5 according to an embodiment of the present invention will be described in detail.

Figure 3:
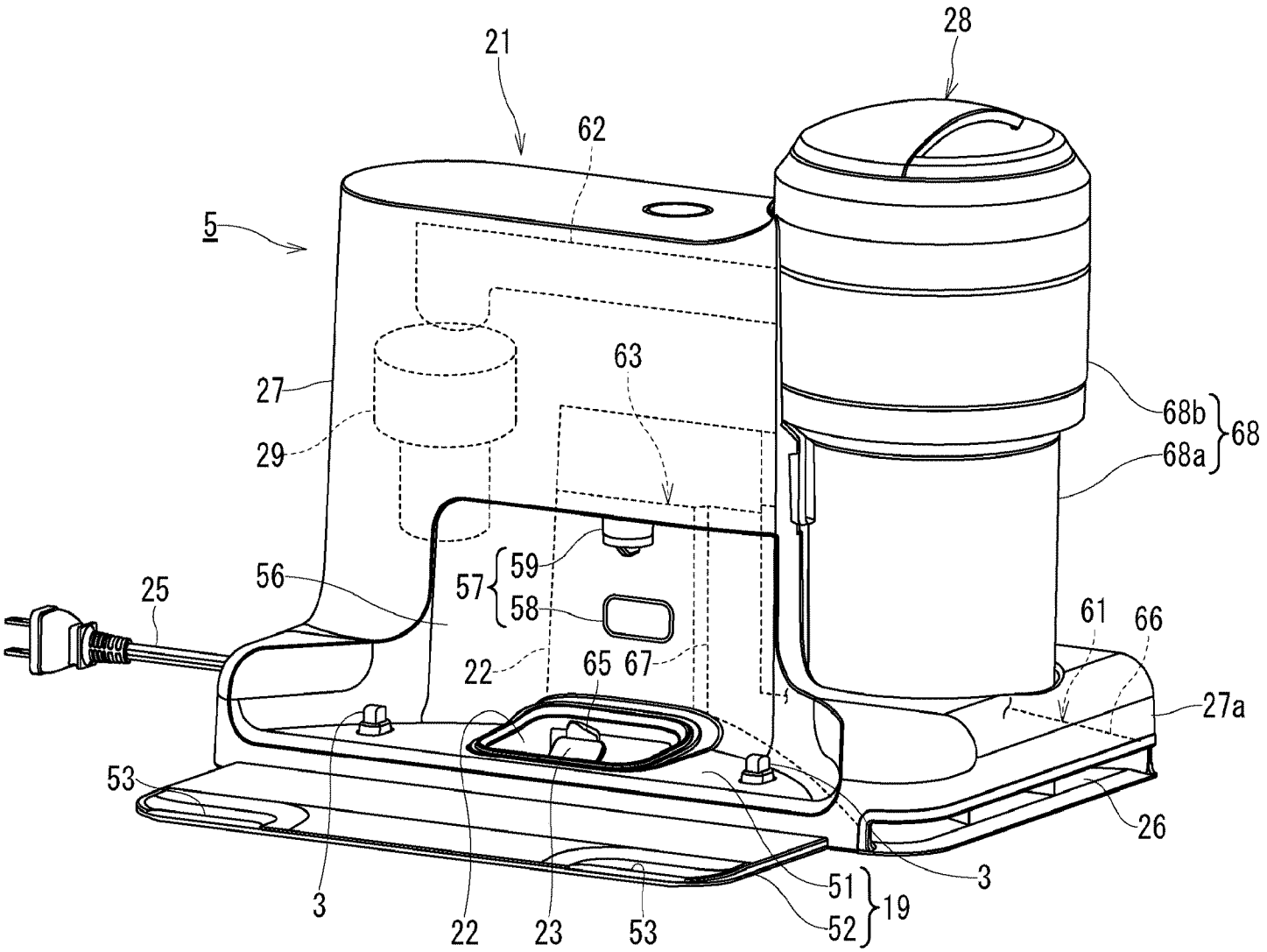
FIG. 3 is a perspective view illustrating a station of the electric vacuum cleaning apparatus according to the embodiment of the present invention.

FIG. 3 is a perspective view illustrating the station of the electric vacuum cleaning apparatus according to the embodiment of the present invention.

Figure 4:
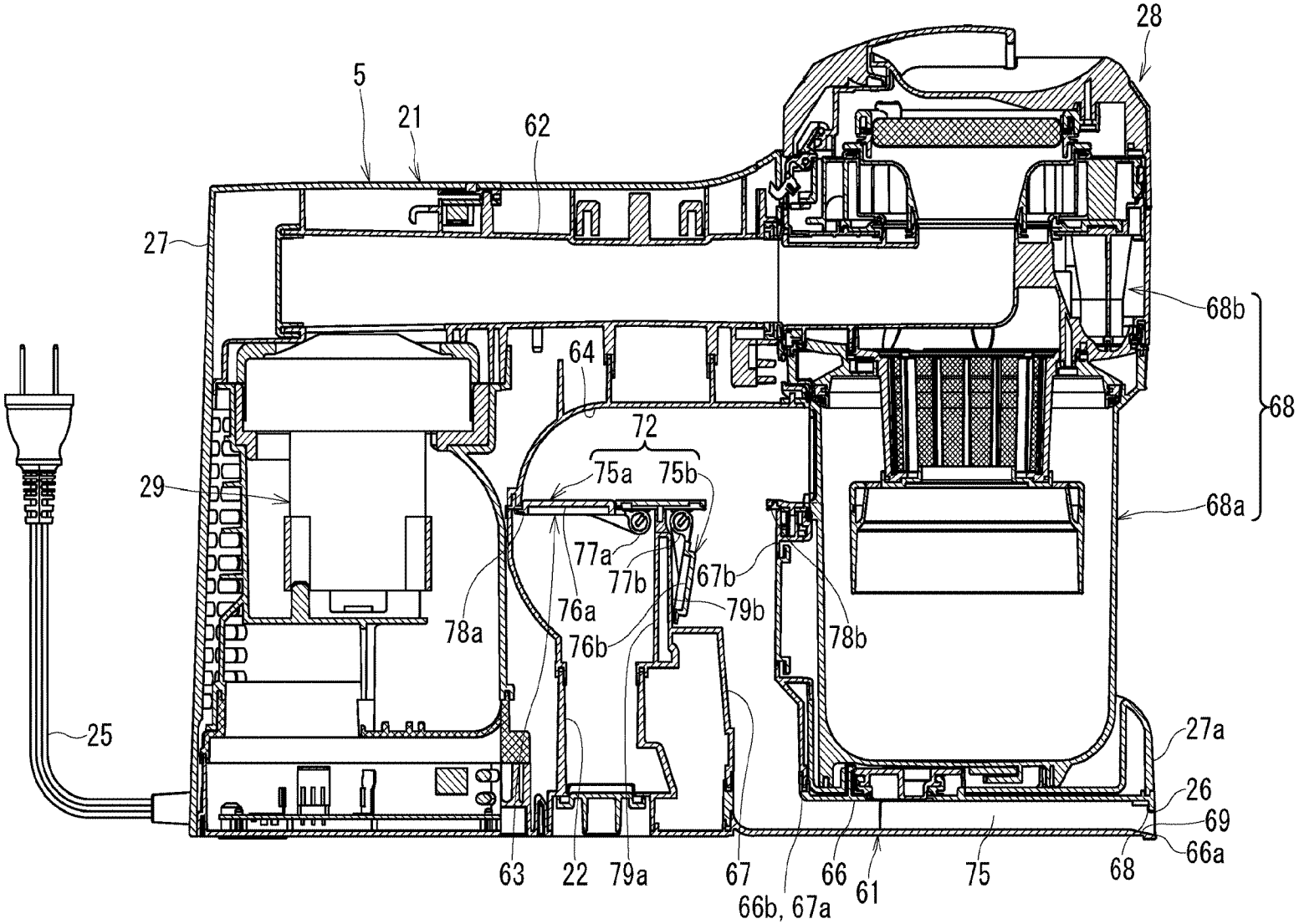
FIG. 4 is a transverse cross-sectional view illustrating the station of the electric vacuum cleaning apparatus according to the embodiment of the present invention.

FIG. 4 is a transverse sectional view illustrating the station of the electric vacuum cleaning apparatus according to the embodiment of the present invention.

As illustrated in FIG. 3 and FIG. 4, the base part 19 of the station 5 according to the present embodiment projects to the front side of the station 5 and expands in a rectangular shape. The base part 19 includes a high floor part 51 that joins to a bottom portion of the dust collector 21, and a low floor section 52 that projects from the high floor part 51 forward the front of the station 5. The low floor section 52 and the high floor part 51 extend in a strip shape in the width direction of the station 5. The charging electrodes 3 and an inlet port of the dust transfer pipe 22 are arranged on the high floor part 51.

The autonomous robotic vacuum cleaner 2 arrives at the home position with the driving wheels 45 that ride onto the low floor section 52 and with a posture that has the primary dust container 12 arranged above the high floor part 51.

The base part 19 includes convexo-concave shaped running surfaces 53 that decrease the area of contact between each of the pair of driving wheels 45 and the ground when the autonomous robotic vacuum cleaner 2 moves homeward the position (home position) where the autonomous robotic vacuum cleaner 2 is electrically connected to the charging electrodes 3. Each of the running surfaces 53 is a plurality of linear projections and depressions, lattice-shaped projections and depressions or a plurality of hemispherical projections and depressions that are provided at one section of the base part 19.

The dust collector 21 includes the second body case 27 having the second intake port 26 that sucks in other dust that is different from the dust collected by the autonomous robotic vacuum cleaner 2, the secondary dust container 28 that accumulates dust that is discarded from the primary dust container 12 through the dust transfer pipe 22, the secondary electric blower 29 that is housed inside the second body case 27 and is connected to the secondary dust container 28, and the power cord 25 that supplies electric power from a commercial alternating current power source to the secondary electric blower 29 and the charging electrodes 3.

The second body case 27 is a housing of an appropriate shape that can be placed on the surface and is arranged at a rear part of the station 5 and extends further upward than the base part 19. The second body case 27 includes a wall 27*a* that has a height relative to the installation surface. The wall 27*a* corresponds to a right side wall of the second body case 27. The second body case 27 has an appropriate shape for ensuring that the second body case 27 does not interfere with the autonomous robotic vacuum cleaner 2 even when the autonomous robotic vacuum cleaner 2 homes to the home position.

The second body case 27 is short in a depth direction where the autonomous robotic vacuum cleaner 2 travels when homing to the home position, and is long in a width direction. The secondary dust container 28 is arranged in one half-portion in the width direction of the second body case 27, specifically, a right-side half portion. The secondary electric blower 29 is housed in another half-portion of the second body case 27, specifically, a left-side half portion.

A front wall of the second body case 27 includes an arc-shaped recess 56 that corresponds to a rear end part of the autonomous robotic vacuum cleaner 2. The inlet port of the dust transfer pipe 22 extends from the high floor part 51 of the base part 19 to the recess 56. A homing detector 57 is provided in the recess 56. The homing detector 57 detects whether or not the autonomous robotic vacuum cleaner 2 has arrived at the position (home position) where the autonomous robotic vacuum cleaner 2 is electrically connected to the charging electrodes 3.

The homing detector 57 is a so-called "objective sensor" or "proximity sensor" that utilizes visible light or infrared light to detect a relative distance between itself and the autonomous robotic vacuum cleaner 2. The homing detector 57 includes a first sensor 58 that detects a relative distance between itself and the autonomous robotic vacuum cleaner 2 in the front direction of the dust collector 21, and a second sensor 59 that detects a relative distance between itself and the autonomous robotic vacuum cleaner 2 in the height direction of the second body case 27.

The second intake port 26 is applied for the purpose of sucking in dust that is swept up together with the cleaning implement other than the autonomous robotic vacuum cleaner 2 and dust that adheres to the cleaning implement itself. The second intake port 26 is provided in a lower portion of the wall 27*a* that has a height relative to the installation surface, that is, in a lower portion of the right wall of the second body case 27. The second intake port 26 has an appropriate width along the installation surface, and an appropriate height in the normal direction (height direction) of the installation surface.

The pair of charging electrodes 3 are arranged so as to place the inlet port of the dust transfer pipe 22 there between. Each of the charging electrodes 3 is arranged on the front at corresponding edges on the left and right of the recess 56.

In addition to the dust transfer pipe 22, a suction passage 61 and a downstream pipe 62 are provided inside the second body case 27. The suction passage 61 fluidly connects the second intake port 26 and the secondary dust container 28. The downstream pipe 62 fluidly connects the secondary dust container 28 and the secondary electric blower 29.

The dust transfer pipe 22 is a first suction channel that is connected to the autonomous robotic vacuum cleaner 2 in a state where the autonomous robotic vacuum cleaner 2 has homed to the station 5, and that sucks in dust collected by the autonomous robotic vacuum cleaner 2. The suction passage 61 is a second suction channel that sucks in other dust that is different from the dust collected by the autonomous robotic vacuum cleaner 2.

The dust transfer pipe 22 and the suction passage 61 are each connected to a suction side (upstream side) of the secondary dust container 28. That is, the negative pressure that the secondary electric blower 29 generates can act in each of the dust transfer pipe 22 and the suction passage 61 through the secondary dust container 28. The station 5 also includes a channel switching unit 63. When moving dust from the autonomous robotic vacuum cleaner 2 to the station 5, the channel switching unit 63 allows a fluid connection between the dust transfer pipe 22 and the secondary dust container 28, while blocks a fluid connection between the suction passage 61 and the secondary dust container 28. This is a state where the first suction channel connects to the secondary electric blower 29, and the second suction channel is separated from the secondary electric blower 29, and is referred to as a "first switching state". Further, when applying the negative pressure at the second intake port 26, the channel switching unit 63 blocks the fluid connection between the dust transfer pipe 22 and the secondary dust container 28, while allows a fluid connection between the suction passage 61 and the secondary dust container 28. This is a state where the second suction channel connects to the secondary electric blower 29, and the first suction channel is separated from the secondary electric blower 29, and is referred to as a "second switching state". The channel switching unit 63 switches between these two states.

Note that the dust transfer pipe 22 and the suction passage 61 are fluidly connected to the secondary dust container 28 via a junction pipe 64 that is connected to both of the channels. The junction pipe 64 connects the channel switching unit 63 and the secondary dust container 28.

The dust transfer pipe 22 detachably connects the autonomous robotic vacuum cleaner 2 and the secondary dust container 28. In a positional relationship where the autonomous robotic vacuum cleaner 2 is electrically connected to the charging electrodes 3, that is, home position, the dust transfer pipe 22 contacts the attaching part 39 of the primary dust container 12 of the autonomous robotic vacuum cleaner 2 and is airtightly connected to the disposal port 41.

The lever 23 that is disposed in the inlet port of the dust transfer pipe 22 includes a hook 65 that extends in the frontward direction and also in the upward direction of the dust collector 21.

The suction passage 61 is provided inside the second body case 27. The suction passage 61 includes a suction chamber 66 that is connected to the second intake port 26, and a riser pipe 67 that fluidly connects the suction chamber 66 and the secondary dust container 28 through the channel switching unit 63.

The suction chamber 66 is arranged below the secondary dust container 28, and extends across a region that is directly below the secondary dust container 28. The suction chamber 66 includes an inflow-side end 66*a* that is connected to the second intake port 26, and an outflow-side end 66*b* that is connected to the riser pipe 67. The suction chamber 66 and the riser pipe 67 fluidly connect the second intake port 26 and the secondary dust container 28.

A depth of the channel (channel length) of the suction chamber 66, that is, a distance between the outflow-side end 66*b* and the inflow-side end 66*a*, is longer than a diameter D of the secondary dust container 28.

The riser pipe 67 is connected to the outflow-side end 66*b* of the suction chamber 66, and rises along the secondary dust container 28. The riser pipe 67 includes a lower end 67*a* that is connected to the outflow-side end 66*b* of the suction chamber 66, and an upper end 67*b* that is connected to the channel switching unit 63.

The secondary dust container 28 is detachably mounted on the right side of the dust collector 21. The secondary dust container 28 is exposed to the external appearance of the dust collector 21. The secondary dust container 28 is fluidly connected to the dust transfer pipe 22 and the suction passage 61. Dust that flows in together with air from the dust transfer pipe 22 or the suction passage 61 is separated from the air and accumulated by the secondary dust container 28. The secondary dust container 28 is fluidly connected to the second intake port 26 through the channel switching unit 63, the riser pipe 67 and the suction chamber 66 in that order. The secondary dust container 28 is disposed above the suction chamber 66.

The secondary dust container 28 includes a centrifugal separator 68 that centrifugally separates dust that flows in together with air from the dust transfer pipe 22 and the second intake port 26 from the air. The centrifugal separator 68 is of a multi-stage type. The centrifugal separator 68 includes a primary centrifugal separation chamber 68*a* that centrifugally separates dust that flows in together with air from the dust transfer pipe 22 and the second intake port 26 from the air, and a secondary centrifugal separation chamber 68*b* that centrifugally separates dust that passes through the primary centrifugal separation chamber 68*a* from air.

The primary centrifugal separation chamber 68*a* centrifugally separates coarse dust from air containing dust that is guided into the secondary dust container 28. The secondary centrifugal separation chamber 68*b* centrifugally separates fine dust from air containing dust that passes through the primary centrifugal separation chamber 68*a*. Note that the term "coarse dust" refers to dust with a large mass such as fiber-type dust that, for example, consists mainly of lint or fuzz balls or to pieces of grit. The term "fine dust" refers to particulate dust or powder-type dust that has a small mass.

The secondary electric blower 29 applies the suction negative pressure to the dust transfer pipe 22 and the second intake port 26 through the downstream pipe 62 and the secondary dust container 28. The suction negative pressure that the secondary electric blower 29 generates acts in the dust transfer pipe 22 or the second intake port 26 depending on the state of the channel switching unit 63.

Next, the channel switching unit 63 of the station 5 according to the embodiment of the present invention will be described in detail.

Figure 5:
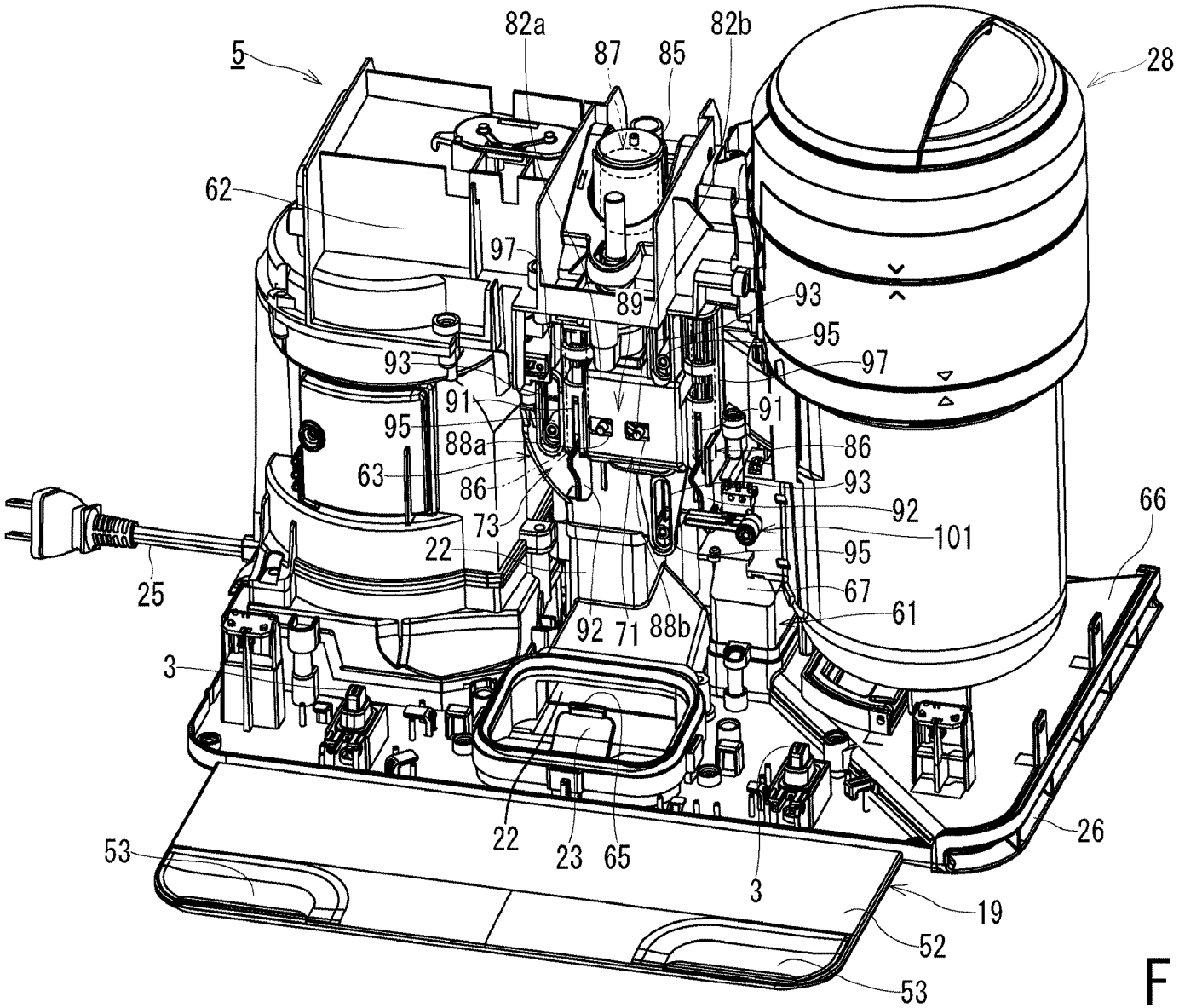
FIG. 5 is a perspective view of a channel switching unit of the station according to the embodiment of the present invention.
Figure 6:
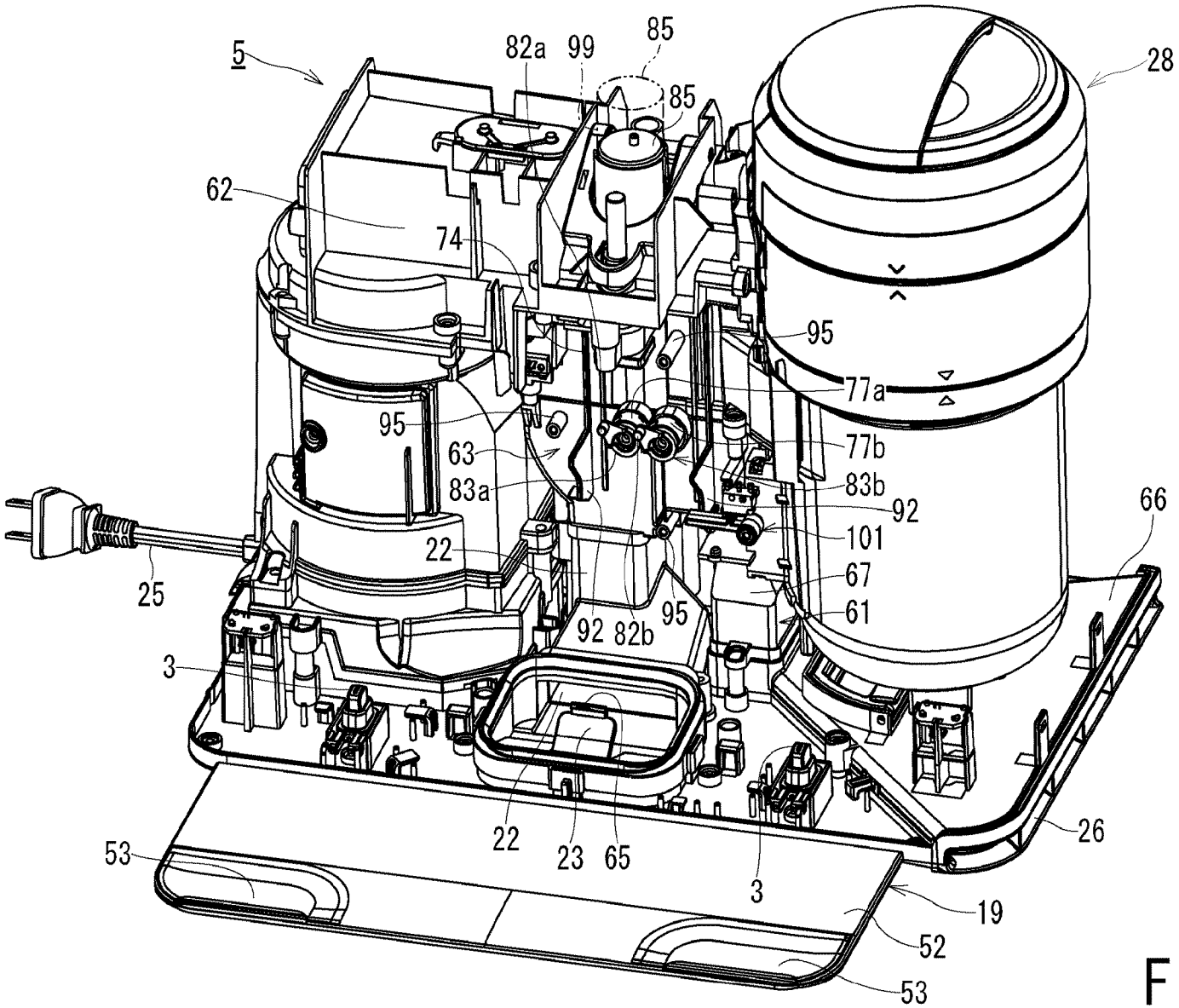
FIG. 6 is a perspective view of the channel switching unit of the station according to the embodiment of the present invention.
Figure 7:
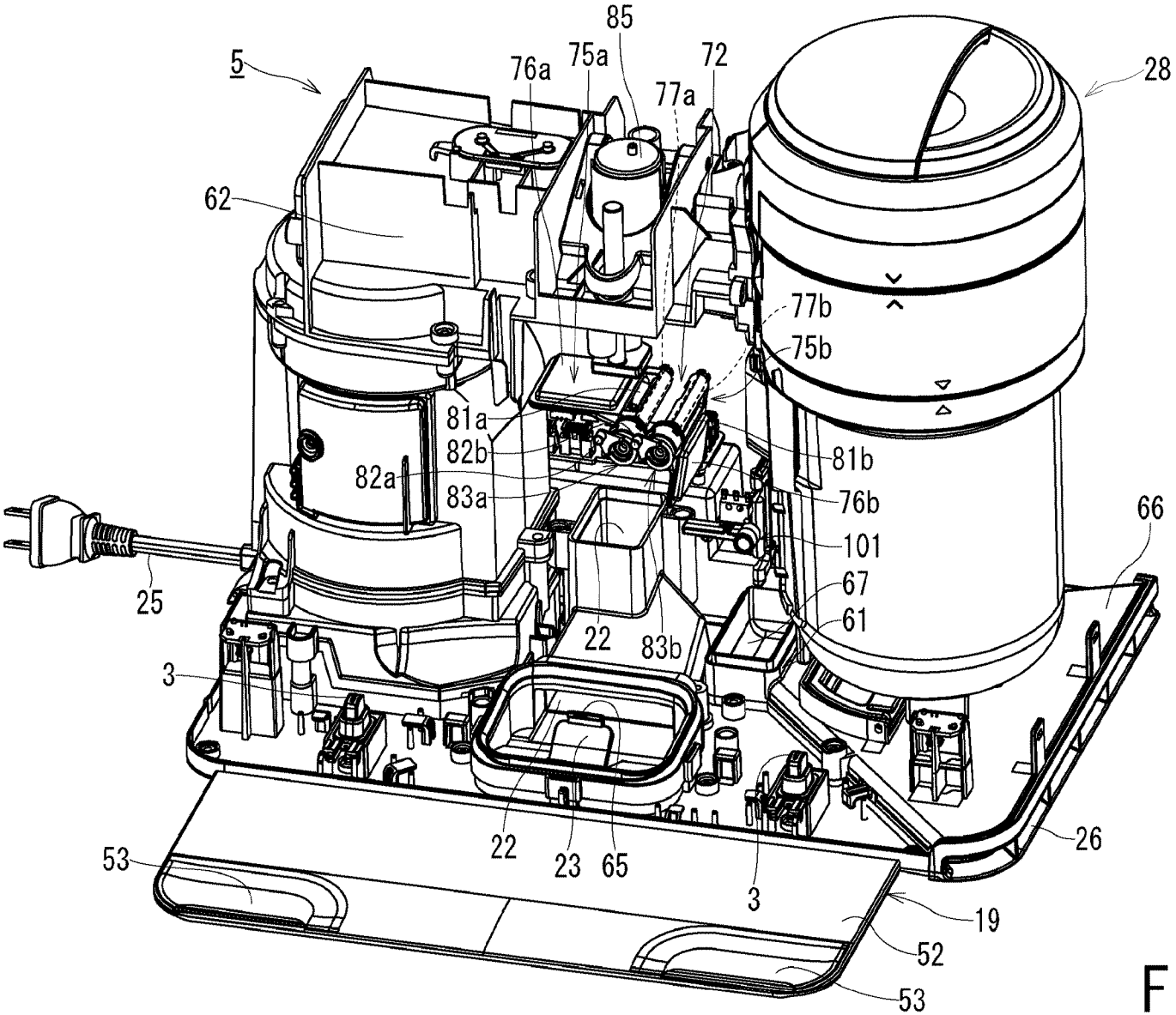
FIG. 7 is a perspective view of the channel switching unit of the station according to the embodiment of the present invention.

FIG. 5 to FIG. 7 are perspective views of the channel switching unit of the station according to the embodiment of the present invention.

FIG. 5 illustrates the channel switching unit 63 inside the station 5, with the second body case 27 being detached. FIG. 6 illustrates a valve switching mechanism 73, with a slider 71 being further detached from FIG. 5. FIG. 7 illustrates the valve switching mechanism 73, with the dust transfer pipe 22, the riser pipe 67 and the junction pipe 64 being further detached from FIG. 6.

As illustrated in FIG. 5 to FIG. 7 in addition FIG. 4, the channel switching unit 63 of the electric vacuum cleaning apparatus 1 according to the present embodiment includes a switching valve unit 72 that is capable of switching the channels that are connected to the secondary dust container 28 so as to allow either one of, and block another of, flowing between the dust transfer pipe 22, that is, the first suction channel and the secondary dust container 28 and flowing between the suction passage 61, that is, the second suction channel and the secondary dust container 28, and the valve switching mechanism 73 that can be switched by a one-time operation (input action) of the switching valve unit 72.

The switching valve unit 72 includes a plurality of the switching valves. Specifically, the switching valve unit 72 include a first switching valve 75*a* that is capable of allowing or blocking flowing between the dust transfer pipe 22 and the secondary dust container 28, and a second switching valve 75*b* that is capable of allowing or blocking flowing between the suction passage 61 and secondary dust container 28.

Further, the switching valve unit 72 include respectively separate valve members and hinges. Specifically, the switching valve unit 72 include, as separate members: the first switching valve 75*a* having a first valve member 76*a* that is capable of allowing or blocking flowing between the dust transfer pipe 22 and the secondary dust container 28, and a first hinge 77*a* that supports the first valve member 76*a*; and the second switching valve 75*b* having a second valve member 76*b* that is capable of allowing or blocking flowing between the suction passage 61 and the secondary dust container 28, and a second hinge 77*b* that supports the second valve member 76*b*. That is, the first switching valve 75*a* and the second switching valve 75*b* include respectively separate valve members (first valve member 76*a* and second valve member 76*b*) and hinges (first hinge 77*a* and second hinge 77*b*).

Each of the valve members (first valve member 76*a* and second valve member 76*b*) is a quadrangular plate body. The valve members (first valve member 76*a* and second valve member 76*b*) have seat surfaces that come in contact with valve seats (a first valve seat 78*a* and a second valve seat 78*b*) provided in the junction pipe 64 and block flowing between the respective channels and the junction pipe 64, and consequently block flowing between the respective channels and the secondary dust container 28.

The hinges (first hinge 77*a* and second hinge 77*b*) are arranged on either side of the valve members (first valve member 76*a* and second valve member 76*b*). Thus, the switching valve unit 72 cause the valve members (first valve member 76*a* and second valve member 76*b*) to rotate around the hinges (first hinge 77*a* and second hinge 77*b*) like doors to open and close the channels.

The first hinge 77*a* and the second hinge 77*b* are installed side by side so as to sandwich a wall that separates the dust transfer pipe 22 and the suction passage 61.

The valve members of the switching valve unit 72 are arranged inside the respective channels. That is, the first valve member 76*a* of the first switching valve 75*a* is arranged in the dust transfer pipe 22, and the second valve member 76*b* of the second switching valve 75*b* is arranged in the suction passage 61.

The switching valve unit 72 open by means of the self-weight of the valve members. That is, when a force for closing the first valve member 76*a* from the valve switching mechanism 73 stops acting, the first switching valve 75*a* opens under the self-weight of the first valve member 76*a* to thereby allow flowing between the dust transfer pipe 22 and the secondary dust container 28. While, when a force for closing the second valve member 76*b* from the valve switching mechanism 73 stops acting, the second switching valve 75*b* opens under the self-weight of the second valve member 76*b* to thereby allow flowing between the suction passage 61 and the secondary dust container 28.

The respective valve members of the switching valve unit 72 open so as to fall towards the upstream side of the channel around the corresponding hinge. Specifically, the first valve member 76*a* opens so as to fall towards the upstream side of the dust transfer pipe 22 around the first hinge 77*a*. The second valve member 76*b* opens so as to fall towards the upstream side of the suction passage 61 around the second hinge 77*b*. Note that, a state where the first switching valve 75*a* is closed and blocks flowing between the dust transfer pipe 22 and the secondary dust container 28, and a state where the second switching valve 75*b* is open and allows flowing between the suction passage 61 and the secondary dust container 28 are illustrated in FIG. 4 and FIG. 7.

The first valve member 76*a* and the first hinge 77*a* are separate members, and the second valve member 76*b* and the second hinge 77*b* are separate members. In a state where the first valve member 76*a* is arranged inside the dust transfer pipe 22, the first hinge 77*a* is inserted through the first valve member 76*a* so as to traverse the dust transfer pipe 22, and supports the first valve member 76*a*. In a state where the second valve member 76*b* is arranged inside the suction passage 61, the second hinge 77*b* is inserted through the second valve member 76*b* so as to traverse the suction passage 61, and supports the second valve member 76*b*.

In this connection, in the switching valve unit 72, because the valve members are accommodated inside the channels and the valve members open so as to fall toward the upstream side of the respective channels around the hinges, there is a concern that the valve members may be blown by air flowing through the channels and forcedly closed unintentionally.

Thus, the station 5 includes: a first recess 79*a* that is provided inside the dust transfer pipe 22 and where the first switching valve 75*a* is accommodated in a state when the first switching valve 75*a* allows flowing between the dust transfer pipe 22 and the secondary dust container 28, and a second recess 79*b* that is provided inside the suction passage 61 and where the second switching valve 75*b* is accommodated in a state when the second switching valve 75*b* allows flowing between the suction passage 61 and the secondary dust container 28. The first recess 79*a* and the second recess 79*b* serve as drifts in the channels, and separate the valve members from a freestream of air flowing through the channels and prevent the valve members from being closed by the freestream.

Each of the valve members of the switching valve unit 72 has a ventilation hole that penetrates through the front and rear surfaces of the valve member in the vicinity of the hinge at an outer region of the seat surface. Specifically, the first valve member 76*a* has a first ventilation hole 81*a* that penetrates through the front and rear surfaces thereof in the vicinity of the first hinge 77*a* at an outer region of the seat surface. The second valve member 76*b* has a second ventilation hole 81*b* that penetrates through the front and rear surfaces thereof in the vicinity of the second hinge 77*b* at an outer region of the seat surface.

The first ventilation hole 81*a* is a slit that opens along the first hinge 77*a*. The second ventilation hole 81*b* is a slit that opens along the second hinge 77*b*.

In the switching valve unit 72, because the valve members are accommodated inside the channel, and the valve members open so as to fall toward the upstream side of the respective channels around the hinges, there is a concern that dust contained in air flowing through the respective channels will enter between the valve member and a wall of the channel.

Thus, the valve members of the switching valve unit 72 discharge dust that entered between the valve members and the wall of the channels from the first ventilation hole 81*a* and the second ventilation hole 81*b*, to thereby prevent dust remaining in a state where the dust is caught between the valve members and the wall of the channels. The valve members of the switching valve unit 72 can reduce a load in the direction where the valve members are closed by a stream of air by releasing air that flows through the channels from the ventilation holes.

The switching valve unit 72 also includes eccentric pins that are eccentrically provided from rotation center of the hinges. That is, the first switching valve 75*a* includes a first eccentric pin 82*a* that is eccentrically provided from rotation center of the first hinge 77*a*. Similarly, the second switching valve 75*b* includes a second eccentric pin 82*b* that is eccentrically provided from rotation center of the second hinge 77*b*.

The eccentric pins are arranged outside of the channels. That is, the first eccentric pin 82*a* is arranged on the outside of the dust transfer pipe 22. The first eccentric pin 82*a* is provided at one end of the first hinge 77*a* that is arranged on the outside of the dust transfer pipe 22. The second eccentric pin 82*b* is arranged on the outside of the suction passage 61. The second eccentric pin 82*b* is provided at one end of the second hinge 77*b* that is arranged on the outside of the suction passage 61. Note that the first hinge 77*a* and the second hinge 77*b* are inserted through the channels from the other end side, which have no eccentric pin, and support the valve members.

The eccentric pins transmit a force that closes the switching valve unit 72. The eccentric pins drive the valve members by circling (or revolving) around the rotation center of the hinges by means of the valve switching mechanism 73 (FIG. 5). That is, the first eccentric pin 82*a* circles (or revolves) around the rotation center of the first hinge 77*a* by means of the valve switching mechanism 73 to close the first valve member 76*a*. The second eccentric pin 82*b* circles (or revolves) around the rotation center of the second hinge 77*b* by means of the valve switching mechanism 73 to close the second valve member 76*b*.

The switching valve unit 72 include elastic pressing mechanisms (a first pressing mechanism 83*a* and a second pressing mechanism 83*b*) that generate a force that presses the corresponding valve member against the valve seat in a state where the valve member blocks flowing between the corresponding channel and the secondary dust container 28. Specifically, the first switching valve 75*a* includes the elastic first pressing mechanism 83*a* that generates a force that presses the first valve member 76*a* against the first valve seat 78*a* in a state where the first valve member 76*a* is blocking flowing between the dust transfer pipe 22 and the secondary dust container 28. The second switching valve 75*b* includes the elastic second pressing mechanism 83*b* that generates a force that presses the second valve member 76*b* against the second valve seat 78*b* in a state where the second valve member 76*b* is blocking flowing between the suction passage 61 and the secondary dust container 28.

The valve switching mechanism 73 switches channels so as to open either one of, and close another of, the first switching valve 75*a* and the second switching valve 75*b* by a one-time operation and thereby allow flowing between the secondary dust container 28 and either one of the dust transfer pipe 22 and the suction passage 61 and block flowing between the secondary dust container 28 and another of the dust transfer pipe 22 and the suction passage 61.

In this case, the one-time operation for switching the switching valve unit 72 by means of the valve switching mechanism 73 is an operation or action that moves an input portion such as the push button 85, a knob or a lever in one direction, including, for example, an operation or action that depresses the push button 85, an operation or action that pulls up a knob (not illustrated in the drawings) that takes the place of the push button 85, an operation or action turns a knob (not illustrated in the drawings) in one direction, and an operation or action that tilts a lever in one direction.

The valve switching mechanism 73 includes the slider 71 that generates a driving force for opening and closing the switching valve unit 72 by a reciprocating motion, a power source 86 that causes a force to act on the slider 71 so as to actuate the switching valve unit 72 to enter a state that blocks flowing between the dust transfer pipe 22 and the secondary dust container 28 and allows flowing between the suction passage 61 and the secondary dust container 28, and the push button 85 for an operation that interlocks with the slider 71.

The valve switching mechanism 73 includes a clutch 87 that maintains the switching valve unit 72 in a state where the switching valve unit 72 allows flowing between the dust transfer pipe 22 and the secondary dust container 28 and blocks flowing between the suction passage 61 and the secondary dust container 28, and temporarily prevents movement of the slider 71.

The slider 71 has a box shape and is arranged at the front side of the dust transfer pipe 22 and the suction passage 61, and covered over one of the ends of the hinges (first hinge 77*a* and second hinge 77*b*) of the switching valve unit 72.

Guide slots (first guide slot 88*a* and second guide slot 88*b*) where the eccentric pins (first eccentric pin 82*a* and second eccentric pin 82*b*) of the switching valve unit 72 are arranged are provided in the slider 71. A scotch yoke 89 includes the guide slots (first guide slot 88*a* and second guide slot 88*b*) that are provided in the slider 71, and the eccentric pins (first eccentric pin 82*a* and second eccentric pin 82*b*) that are eccentrically provided from rotation center of the hinges (first hinge 77*a* and second hinge 77*b*) of the switching valve unit 72 and are arranged in the guide slots.

The scotch yoke 89 transmits a reciprocating motion of the slider 71 to the eccentric pins arranged in the guide slots, to convert the reciprocating motion to a force that closes the switching valve unit 72. That is, the scotch yoke 89 transmits a reciprocating motion of the slider 71 to the first eccentric pin 82*a* arranged in the first guide slot 88*a*, to convert the reciprocating motion to a force that closes the first switching valve 75*a*. The scotch yoke 89 transmits a reciprocating motion of the slider 71 to the second eccentric pin 82*b* arranged in the second guide slot 88*b*, to convert the reciprocating motion to a force that closes the second switching valve 75*b*. Note that, as a mechanism that transmits the reciprocating motion of the slider 71 to the eccentric pins (first eccentric pin 82*a* and second eccentric pin 82*b*) and converts the reciprocating motion to a motion that opens or closes the switching valve unit 72 (first switching valve 75*a* and second switching valve 75*b*), instead of the scotch yoke 89 the valve switching mechanism 73 may have a mechanical structure such as a mechanism that combines a plurality of gears, a crank mechanism or a cam mechanism.

The slider 71 has a pair of slits 91 that determine a movement direction. The slits 91 are inserted onto ribs 92 provided on the channel side, and cause the slider 71 to make a smooth reciprocating motion.

The slider 71 is supported in a manner enabling reciprocating motion by screws (not illustrated in the drawings) that are secured to bosses 95 arranged in slots 93. The bosses 95 are provided on an outer wall surface of each channel. The slider 71 can be easily assembled by tightening the screws after the slider 71 is covered over one of the ends of the hinges (first hinge 77*a* and second hinge 77*b*) of the switching valve unit 72.

The power source 86 is, for example, a pair of coiled springs 96. The power source 86 causes a spring force to act on the slider 71 so as to actuate the switching valve unit 72 to move to a state that closes the first switching valve 75*a* to block flowing between the dust transfer pipe 22 and the secondary dust container 28, and opens the second switching valve 75*b* to allow flowing between the suction passage 61 and the secondary dust container 28. When the slider 71 moves in a direction that opens the first switching valve 75*a* and closes the second switching valve 75*b*, the pair of coiled springs 96 are compressed and store energy. The pair of coiled springs 96 are arranged at the respective side portions of the slider 71. By arranging the pair of coiled springs 96 in this way, a driving force of the slider 71 is balanced in the direction of reciprocating motion, and the slits 91 of the slider 71 are prevented from catching in the ribs 92.

Cylindrical holders 97 that hold one end of the coiled springs 96 are provided in the slider 71. The other ends of the coiled springs 96 are held on the channel side. Specifically, the other ends of each coiled springs 96 are supported by the ribs 92 inside the slits 91 arranged in the holders 97.

A buttonhole 27*b* that exposes the push button 85 is provided in a top part of the second body case 27.

The push button 85 is a cylindrical shape, and has a top face as an operation surface that is to be pressed down with a finger, and a tubular side face. An amount by which the push button 85 protrudes from the second body case 27 is greater when the push button 85 is in a raised state than in a state where the push button 85 is pushed down.

The push button 85 includes a sign 99 that is exposed to outside of the second body case 27 and can be visually recognized when the push button 85 is in the raised state. The sign 99 is provided on the side face of the push button 85.

Note that in a state where the push button 85 is pressed down, the switching valve unit 72 enters a state where flowing through the dust transfer pipe 22 is allowed and flowing through the suction passage 61 is blocked. In a state where the push button 85 is raised, the switching valve unit 72 enters a state where flowing through the dust transfer pipe 22 is blocked and flowing through the suction passage 61 is allowed.

The clutch 87 is installed inside the cylindrical push button 85. Although a specific description and diagrammatic illustration is omitted herein, the clutch 87 is equipped with, for example, a similar structure to that of a knock-type ballpoint pen. The clutch 87 includes a groove that is arranged inside the cylindrical push button 85, the push button 85 that has a protrusion that engages with the groove, and a mover that changes a position in an axial direction within the cylinder by entering either of a state where the mover engages with the groove together with the push button 85 and a state where the mover has come out from the groove inside the cylinder and catches at an end of the groove. When the push button 85 is pushed downward, in a similar manner to when a ball pen holds an ink core in a state where the tip of the pen is protruded, the clutch 87 holds the slider 71 with the mover in a state where flowing through the dust transfer pipe 22 is allowed and flowing through the suction passage 61 is blocked.

Note that the clutch 87 obtains a force for pushing the mover back into the groove from the coiled springs 96 of the power source 86. That is, the coiled springs 96 also serve as one part of the clutch 87.

The valve switching mechanism 73 includes a switching detector 101 that drives the secondary electric blower 29 when flowing between the dust transfer pipe 22 and the secondary dust container 28 is blocked and flowing between the suction passage 61 and the secondary dust container 28 is allowed.

The switching detector 101 includes, for example, a microswitch, and is electrically connected to a first control circuit (not illustrated in the drawings) of the secondary electric blower 29. The switching detector 101 detects that flowing between the dust transfer pipe 22 and the secondary dust container 28 is blocked and flowing between the suction passage 61 and the secondary dust container 28 is allowed based on the position of the slider 71, and drives the secondary electric blower 29. The switching detector 101 detects that flowing between the dust transfer pipe 22 and the secondary dust container 28 is blocked and flowing between the suction passage 61 and the secondary dust container 28 is allowed, by opening or closing an electric circuit depending on the position of the slider 71. Thus, in the electric vacuum cleaning apparatus 1, when a state is entered where flowing between the dust transfer pipe 22 and the secondary dust container 28 is blocked and flowing between the suction passage 61 and the secondary dust container 28 is allowed, the secondary electric blower 29 is operated using the first control circuit based on a detection result of the switching detector 101, and sucks in dust from the second intake port 26.

Note that, the station 5 includes a second control circuit (not illustrated in the drawings) that, based on a detection result of another detector (for example, the homing detector 57), performs operational control of the secondary electric blower 29 for transferring dust from the autonomous robotic vacuum cleaner 2 to the station 5 when the autonomous robotic vacuum cleaner 2 returns home to the station 5.

Next, the pressing mechanisms (first pressing mechanism 83*a* and second pressing mechanism 83*b*) of the switching valve unit 72 will be described in detail.

Figure 8:
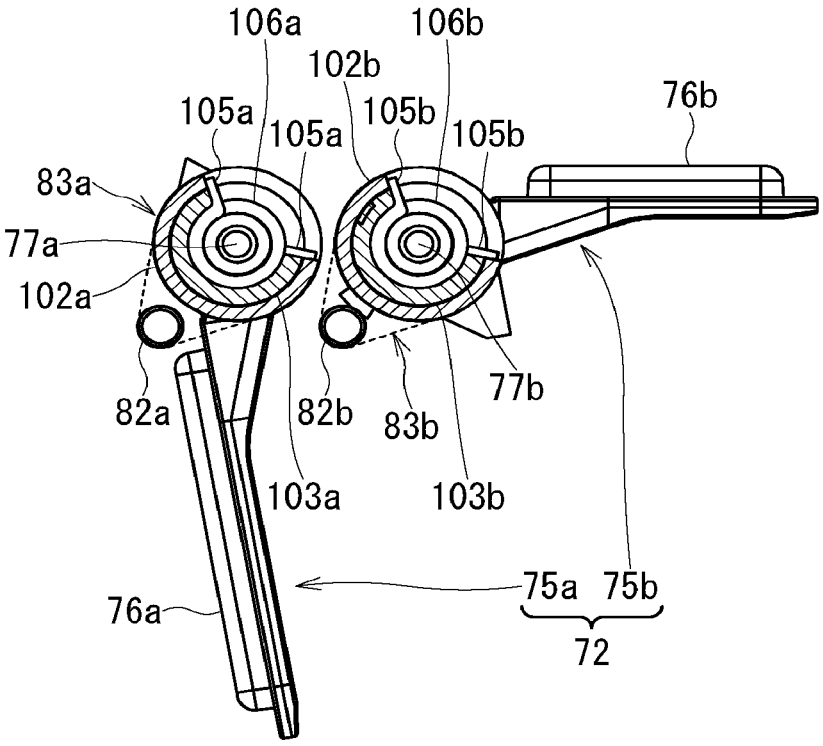
FIG. 8 is a cross-sectional view of a pressing mechanism of the station according to the embodiment of the present invention.

FIG. 8 is a cross-sectional view of the pressing mechanisms of the station according to the embodiment of the present invention.

FIG. 8 illustrates a state where the first switching valve 75*a* is open and the second switching valve 75*b* is closed, and the pressing mechanisms (first pressing mechanism 83*a* and second pressing mechanism 83*b*) are in a neutral state.

As illustrated in FIG. 8, the first pressing mechanism 83*a* of the station 5 according to the present embodiment includes a circular arc-shaped first outer wheel 102*a* that is fixed to either one of the first valve member 76*a* and the first eccentric pin 82*a*, a circular arc-shaped first inner wheel 103*a* that is arranged inside the first outer wheel 102*a* and is fixed to another one of the first valve member 76*a* and the first eccentric pin 82*a*, and a first torsion spring 106*a* that is arranged inside the first inner wheel 103*a*, and that is twisted by a phase difference between the first outer wheel 102*a* and the first inner wheel 103*a* and stores energy.

The second pressing mechanism 83*b* includes a circular arc-shaped second outer wheel 102*b* that is fixed to either one of the second valve member 76*b* and the second eccentric pin 82*b* a circular arc-shaped second inner wheel 103*b* that is arranged inside the second outer wheel 102*b* and is fixed to another one of the second valve member 76*b* and the second eccentric pin 82*b*, and a second torsion spring 106*b* that is arranged inside the second inner wheel 103*b*, and that is twisted by a phase difference between the second outer wheel 102*b* and the second inner wheel 103*b* and stores energy.

The pressing mechanisms (first pressing mechanism 83*a* and second pressing mechanism 83*b*) are arranged on the other side of the channels together with the eccentric pins. That is, the first pressing mechanism 83*a* is arranged on the outside of the dust transfer pipe 22, and the second pressing mechanism 83*b* is arranged on the outside of the suction passage 61. The first pressing mechanism 83*a* is provided together with the first eccentric pin 82*a* at one end of the first hinge 77*a* that is arranged on the outside of the dust transfer pipe 22. The second pressing mechanism 83*b* is provided together with the second eccentric pin 82*b* at one end of the second hinge 77*b* that is arranged on the outside of the suction passage 61.

The first outer wheel 102*a* has a "C" shape where a notch is formed at one part of an annular ring.

Similarly to the first outer wheel 102*a*, the first inner wheel 103*a* has a "C" shape where a notch is formed at one part of an annular ring. The first inner wheel 103*a* is loosely fitted inside the first outer wheel 102*a*, and rotatably supported therein. The centers of the first inner wheel 103*a* and the first outer wheel 102*a* substantially match the center of the first hinge 77*a* of the first switching valve 75*a*. Thus, the first eccentric pin 82*a* can move around the rotation center of the first hinge 77*a* and change an angle formed with the first valve member 76*a* (angle formed around the first hinge 77*a*).

The second outer wheel 102*b* has a "C" shape where a notch is formed at one part of an annular ring.

Similarly to the second outer wheel 102*b*, the second inner wheel 103*b* has a "C" shape where a notch is formed at one part of an annular ring. The second inner wheel 103*b* is also loosely fitted inside the second outer wheel 102*b*, and rotatably supported therein. The centers of the second inner wheel 103*b* and the second outer wheel 102*b* also substantially match the center of the second hinge 77*b* of the second switching valve 75*b*. Thus, the second eccentric pin 82*b* can also move around the rotation center of the second hinge 77*b* and change an angle formed with the second valve member 76*b* (angle formed around the second hinge 77*b*).

The respective notches of the first inner wheel 103*a* and the first outer wheel 102*a* have substantially the same central angle, and overlap in phase when the first eccentric pin 82*a* is at a neutral position with respect to the first valve member 76*a*. The respective notches of the second inner wheel 103*b* and the second outer wheel 102*b* also have substantially the same central angle, and overlap in phase when the second eccentric pin 82*b* is at a neutral position with respect to the second valve member 76*b*.

The first torsion spring 106*a* has a pair of arms 105*a* that come in contact with respective notch ends of the first outer wheel 102*a* and the first inner wheel 103*a*. When the first eccentric pin 82*a* is at the neutral position, the respective arms 105*a* of the first torsion spring 106*a* press against both open ends of the notches of the first inner wheel 103*a* and the first outer wheel 102*a*. That is, the first torsion spring 106*a* exerts a spring force toward a neutral position where the phases of the two notches of the first inner wheel 103*a* and the first outer wheel 102*a* match. When the first eccentric pin 82*a* moves around the first hinge 77*a* and the phases of the two notches of the first inner wheel 103*a* and the first outer wheel 102*a* do not match, that is, the notches no longer overlap with each other, the first torsion spring 106*a* exerts a spring force that pushes back the two wheels to the neutral position where the notches match.

The first torsion spring 106*a* is set so as to be able to exert a spring force of a degree that, in a state (a free state) where the first valve member 76*a* does not contact the first valve seat 78*a*, maintains a neutral position where the notches of both the first inner wheel 103*a* and the first outer wheel 102*a* overlap (match) even if the first eccentric pin 82*a* circles (or revolves) around the first hinge 77*a* by means of the valve switching mechanism 73, or of a degree that minutely suppresses a phase difference and does not inhibit closing of the first valve member 76*a*.

The second torsion spring 106*b* has a pair of arms 105*b* that come in contact with respective notch ends of the second outer wheel 102*b* and the second inner wheel 103*b*. When the second eccentric pin 82*b* is at the neutral position, the respective arms 105*b* of the second torsion spring 106*b* also press against both open ends of the notches of the second inner wheel 103*b* and the second outer wheel 102*b*. That is, the second torsion spring 106*b* also exerts a spring force toward a neutral position where the phases of the two notches of the second inner wheel 103*b* and the second outer wheel 102*b* match. When the second eccentric pin 82*b* moves around the second hinge 77*b* and the phases of the two notches of the second inner wheel 103*b* and the second outer wheel 102*b* do not match, that is, the notches no longer overlap with each other, the second torsion spring 106*b* exerts a spring force that pushes back the two wheels to the neutral position at which the notches match.

The second torsion spring 106*b* is also set so as to be able to exert a spring force of a degree that, in a state (a free state) where the second valve member 76*b* does not contact the second valve seat 78*b*, maintains a neutral position where the notches of both the second inner wheel 103*b* and the second outer wheel 102*b* overlap (match) even if the second eccentric pin 82*b* circles (or revolves) around the second hinge 77*b* by means of the valve switching mechanism 73, or of a degree that minutely suppresses a phase difference and does not inhibit closing of the second valve member 76*b*.

A force with which the first pressing mechanism 83*a* presses the first valve member 76*a* against the first valve seat 78*a* is greater than a force with which the second pressing mechanism 83*b* presses the second valve member 76*b* against the second valve seat 78*b*. That is, a torque that acts on the first valve member 76*a* that is produced by the spring force that the first torsion spring 106*a* generates is greater than a torque that acts on the second valve member 76*b* that is produced by the spring force that the second torsion spring 106*b* generates.

FIG. 9 to FIG. 13 are views illustrating operating states of the valve switching mechanism and switching valves according to the embodiment of the present invention.

Note that, in FIG. 9 to FIG. 13, in order to represent a movement amount of the slider 71 in an easily understandable fashion, a reference line that passes through the center of the first hinge 77*a* and the second hinge 77*b* is indicated by alternate long and short dashed lines.

Figure 9:
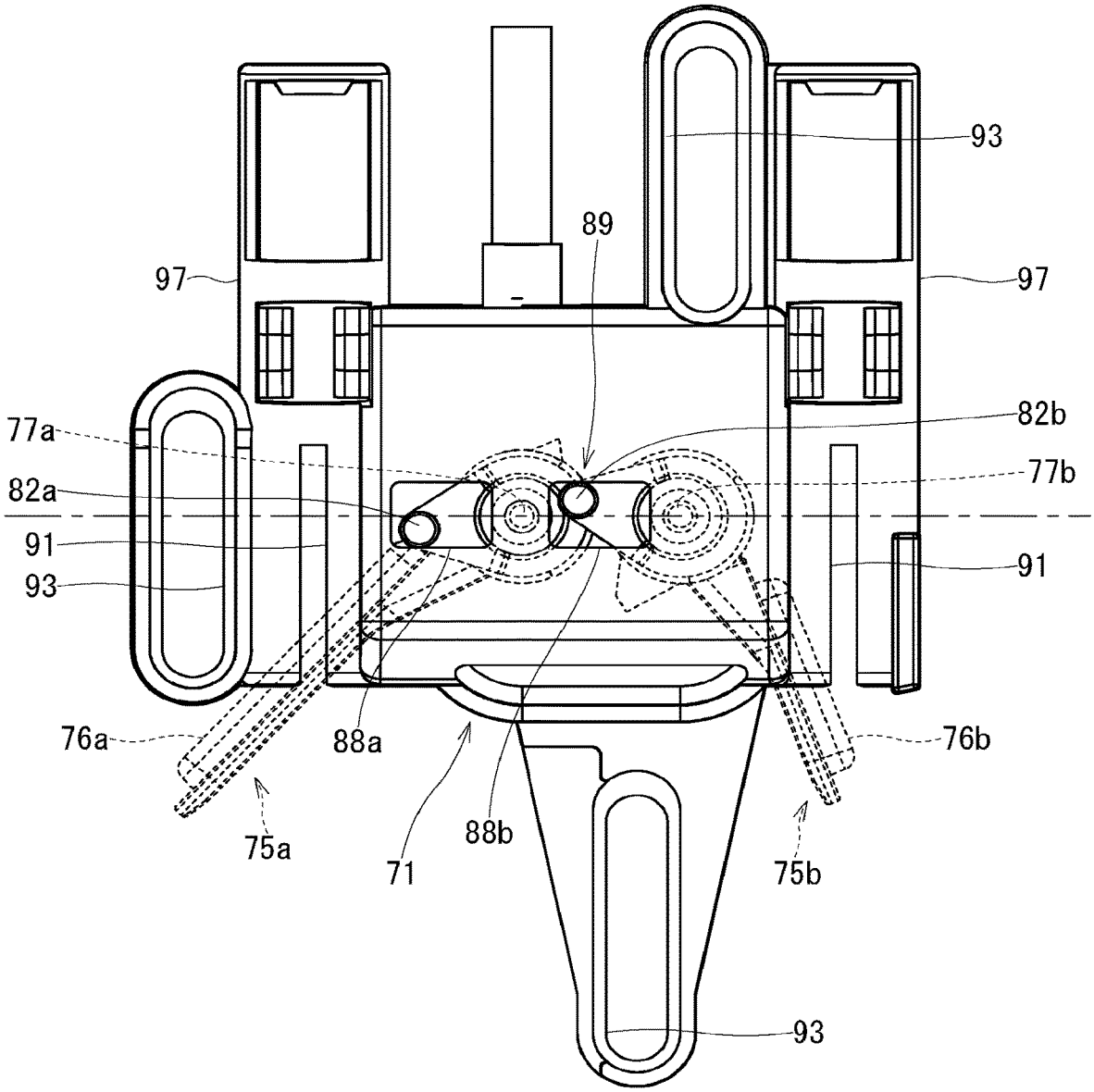
FIG. 9 is a view illustrating an operating state between a valve switching mechanism and a switching valve unit according to the embodiment of the present invention.
Figure 10:
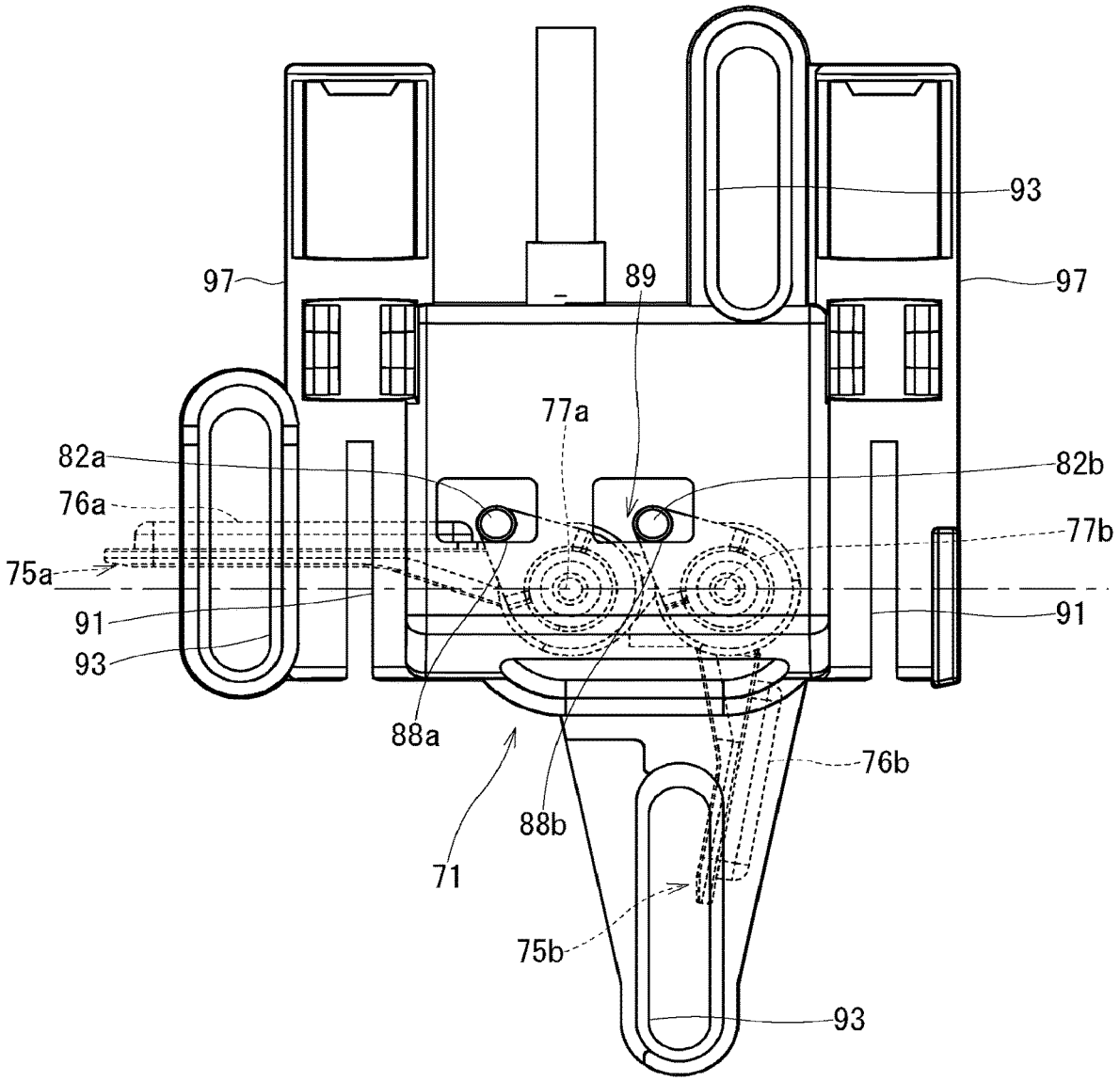
FIG. 10 is a view illustrating an operating state between the valve switching mechanism and the switching valve unit according to the embodiment of the present invention.
Figure 11:
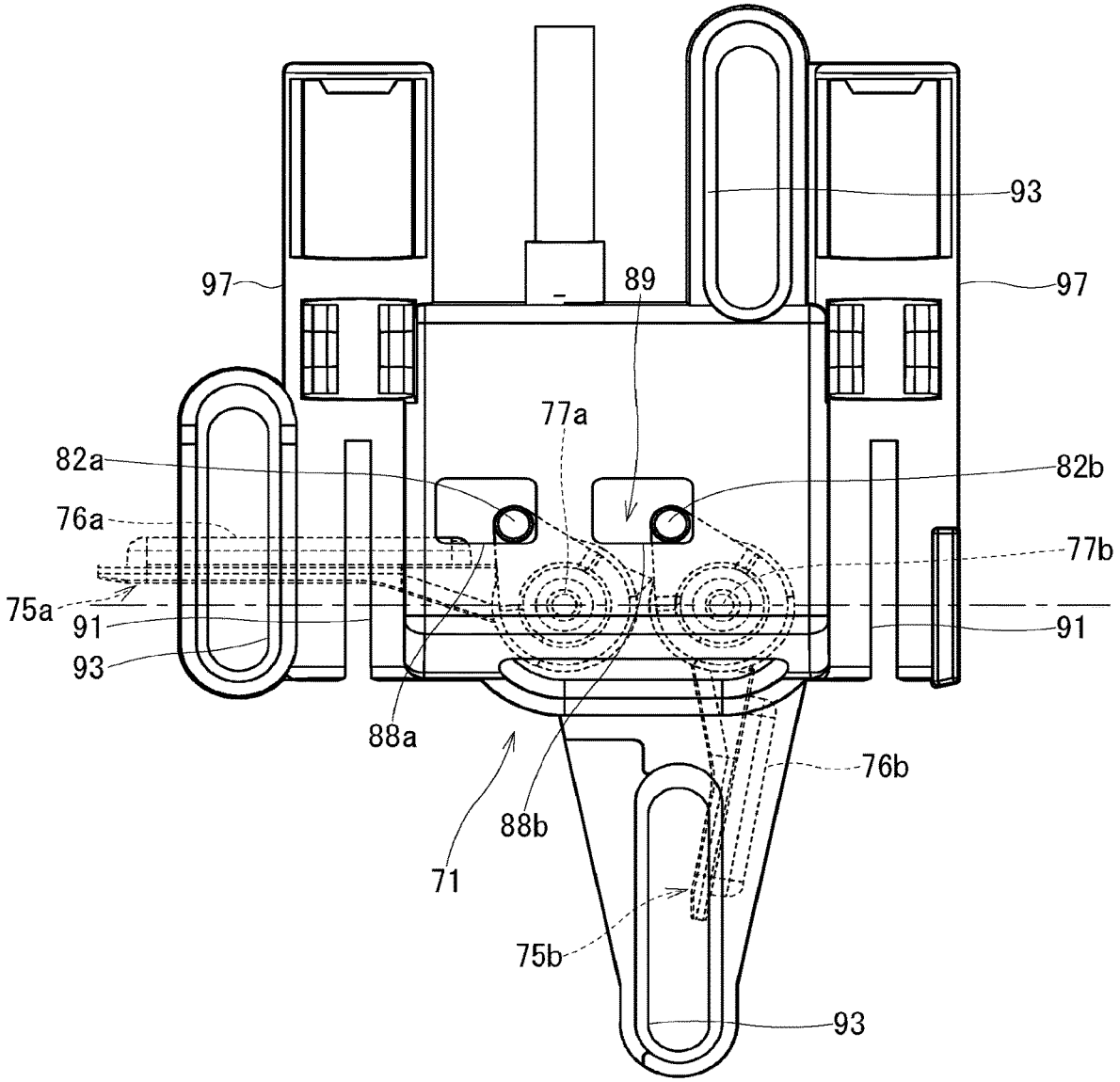
FIG. 11 is a view illustrating an operating state between the valve switching mechanism and the switching valve unit according to the embodiment of the present invention.
Figure 12:
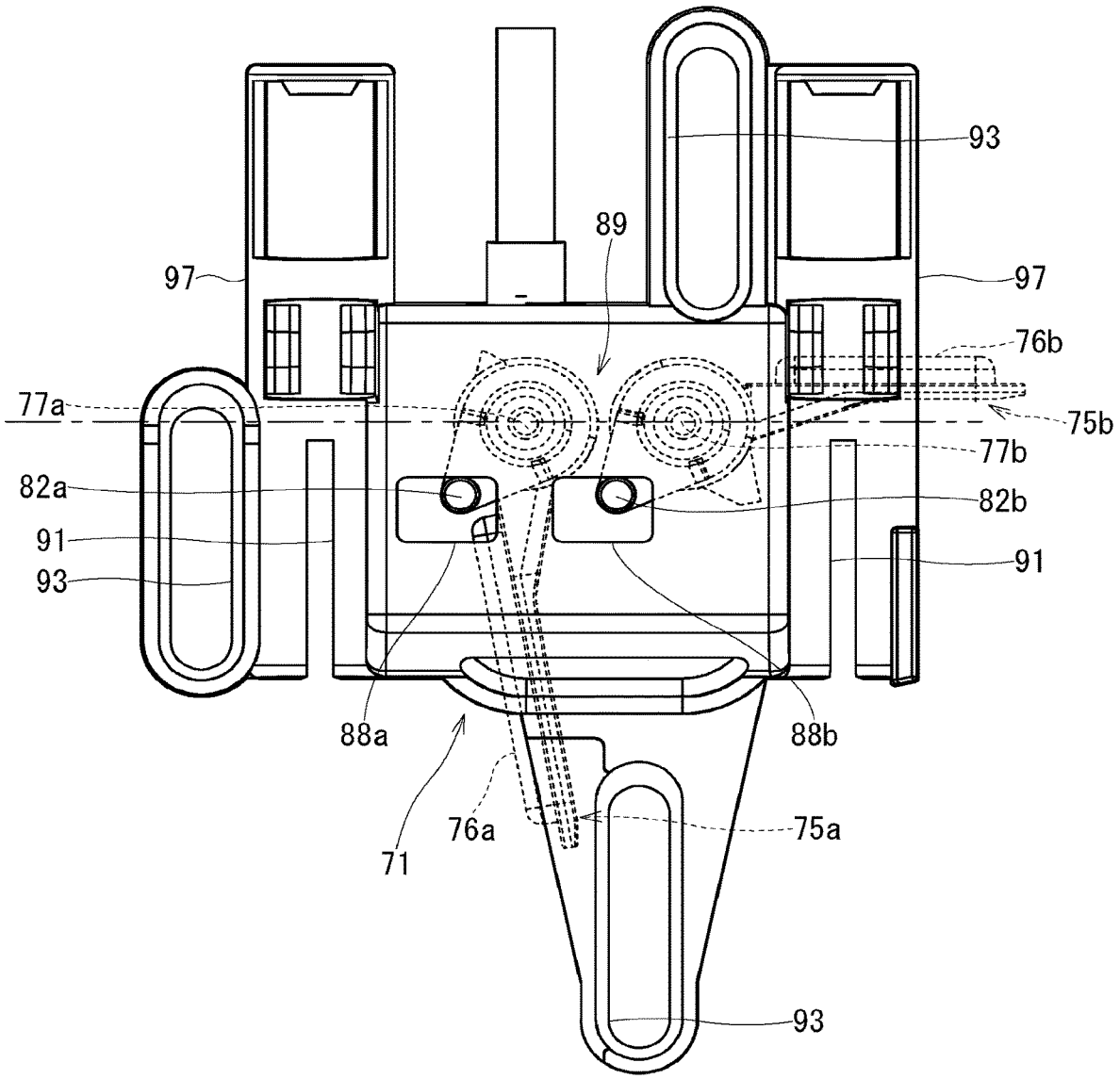
FIG. 12 is a view illustrating an operating state between the valve switching mechanism and the switching valve unit according to the embodiment of the present invention.
Figure 13:
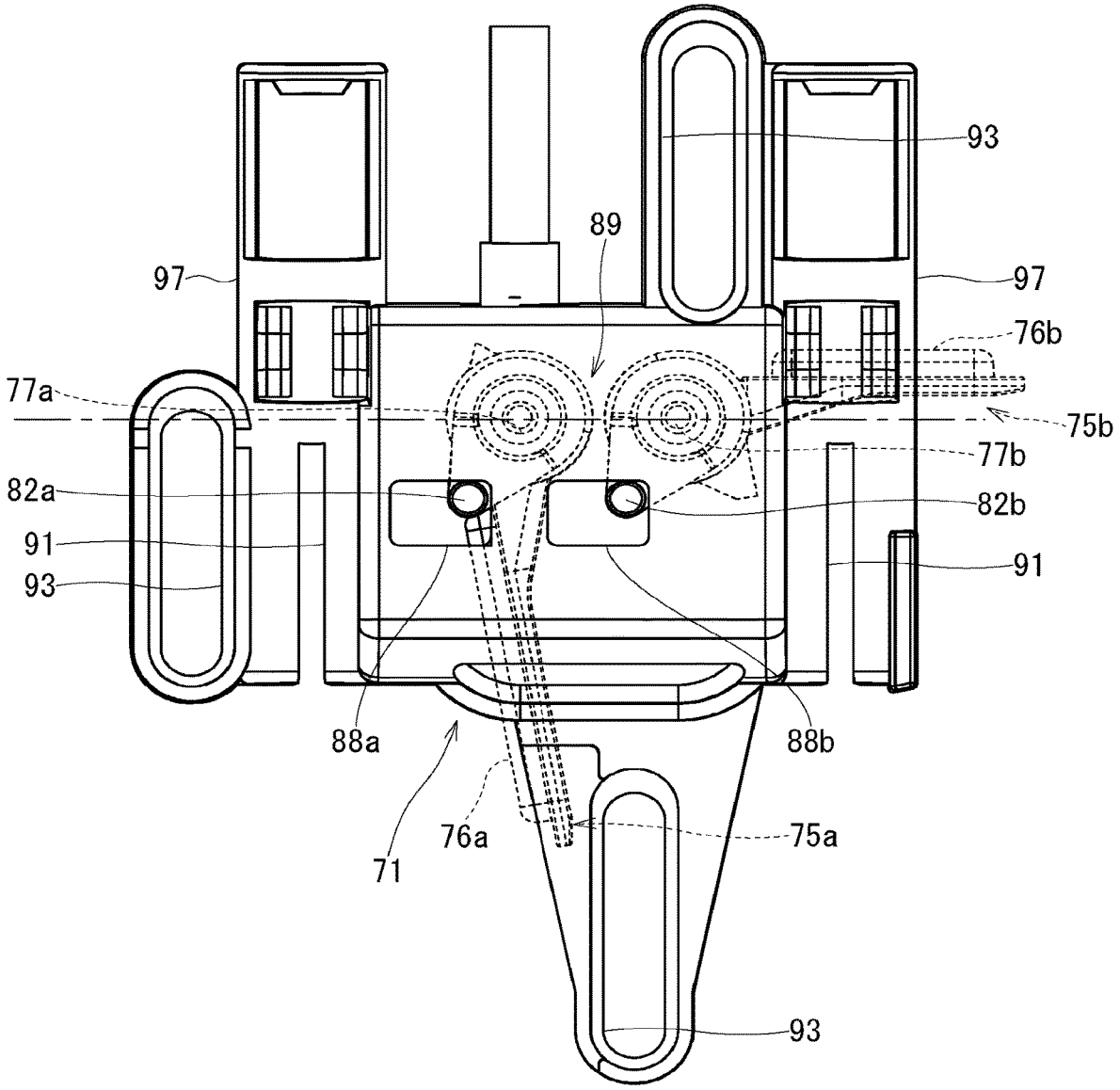
FIG. 13 is a view illustrating an operating state between the valve switching mechanism and the switching valve unit according to the embodiment of the present invention.

FIG. 9 shows a neutral position of the slider 71. FIG. 10 shows a position of the slider 71 when the first valve member 76*a* contacts the first valve seat 78*a*. FIG. 11 shows a position of the slider 71 when the first valve member 76*a* is pressed against the first valve seat 78*a* with the first pressing mechanism 83*a*. FIG. 12 shows a position of the slider 71 when the second valve member 76*b* contacts the second valve seat 78*b*. FIG. 13 shows a position of the slider 71 when the second valve member 76*b* is pressed against the second valve seat 78*b* with the second pressing mechanism 83*b*.

In a case of switching from a state where the first switching valve 75*a* is fully closed and the second switching valve 75*b* is fully open to a state where the first switching valve 75*a* is fully open and the second switching valve 75*b* is fully closed, the state changes as illustrated in the drawings in the order of FIG. 11, FIG. 10, FIG. 9, FIG. 12 and FIG. 13. Conversely, in a case of switching from the state where the first switching valve 75*a* is fully open and the second switching valve 75*b* is fully closed to the state where the first switching valve 75*a* is fully closed and the second switching valve 75*b* is fully open, the state changes as illustrated in the drawings in the order of FIG. 13, FIG. 12, FIG. 9, FIG. 10 and FIG. 11.

As illustrated in FIG. 9 to FIG. 13, in the electric vacuum cleaning apparatus 1 according to the present embodiment, an open state and closed state of the switching valve unit 72 is changed by the slider 71 of the valve switching mechanism 73 performing a reciprocating motion.

Here, to simplify the description, a situation will be described in which the first switching valve 75*a* and the second switching valve 75*b* are changed from a neutral position (FIG. 9) to the state where the first switching valve 75*a* is fully closed and the second switching valve 75*b* is fully open (FIG. 11), and next enter the state where the first switching valve 75*a* is fully open and the second switching valve 75*b* is fully closed (FIG. 13).

When a force to close the first switching valve 75*a* acts on the first eccentric pin 82*a* from the slider 71 at the neutral position (FIG. 9), the first valve member 76*a* tracks the first eccentric pin 82*a* that circles (revolves) around the first hinge 77*a*, and swings (falls down) around the first hinge 77*a* to approach the first valve seat 78*a*. Note that, a force that moves the slider 71, that is, a force that closes the first switching valve 75*a* is based on energy stored in the coiled springs 96 of the power source 86. The push button 85 is pushed upward accompanying movement of the slider 71.

In due course the first valve member 76*a* comes in contact with the first valve seat 78*a* and thereby blocks flowing between the dust transfer pipe 22 and the secondary dust container 28 (FIG. 10). When the slider 71 moves further and a force to close the first switching valve 75*a* acts on the first eccentric pin 82*a* from the valve switching mechanism 73, movement of the first valve member 76*a* that contacts against the first valve seat 78*a* is prevented (FIG. 11), while the first eccentric pin 82*a* circles (revolves) further around the first hinge 77*a*. A phase difference between the first eccentric pin 82*a* and the first valve member 76*a* that arises during this process generates a phase difference between the two notches of the first inner wheel 103*a* and the first outer wheel 102*a* as it is, and thereby squeezes the first torsion spring 106*a*. The force that squeezes the first torsion spring 106*a* is converted to a force that presses the first valve member 76*a* against the first valve seat 78*a*.

During this process (FIG. 9 to FIG. 11) the second switching valve 75*b* opens around the second hinge 77*b* under the self-weight of the second valve member 76*b*.

Subsequently, when the push button 85 is pushed and a force to open the second switching valve 75*b* acts on the second eccentric pin 82*b* from the slider 71, the second valve member 76*b* tracks the second eccentric pin 82*b* that circles (revolves) around the second hinge 77*b*, and swings (falls down) around the second hinge 77*b* to approach the second valve seat 78*b* (FIG. 9). Note that, a force to close the second switching valve 75*b* is an operating force that pushes down the push button 85. The coiled springs 96 of the power source 86 store energy as a result of the push button 85 being pushed down.

In due course the second valve member 76*b* comes in contact with the second valve seat 78*b* and thereby blocks flowing between the suction passage 61 and the secondary dust container 28 (FIG. 12). When the slider 71 moves further and a force to close the second switching valve 75*b* acts on the second eccentric pin 82*b* from the valve switching mechanism 73, movement of the second valve member 76*b* that contacts against the second valve seat 78*b* is prevented (FIG. 13), while the second eccentric pin 82*b* circles (revolves) further around the second hinge 77*b*. A phase difference between the second eccentric pin 82*b* and the second valve member 76*b* that arises during this process generates a phase difference between the two notches of the second inner wheel 103*b* and the second outer wheel 102*b* as it is, and thereby squeezes the second torsion spring 106*b*. The force that squeezes the second torsion spring 106*b* is converted to a force that presses the second valve member 76*b* against the second valve seat 78*b*.

During this process (FIG. 11, FIG. 10, FIG. 9, FIG. 12 and FIG. 13), the first switching valve 75*a* opens around the first hinge 77*a* under the self-weight of the first valve member 76*a*.

In the station 5 according to the present embodiment, if a user unintentionally touches the push button 85 or causes the push button 85 to push in a short period of time within a range of mechanical play of the clutch 87, in some cases the second valve member 76*b* of the second switching valve 75*b* that is open moves in a closing direction. If the second valve member 76*b* comes out to the outside of the second recess 79*b* and is exposed to a freestream in the suction passage 61, the second valve member 76*b* may be closed by the negative pressure that acts in the suction passage 61. And then, because the first valve member 76*a* is strongly pressed against the first valve seat 78*a* by the suction negative pressure, if the second valve member 76*b* closes, the suction side of the secondary electric blower 29 will be fully blocked, which is not desirable.

Thus, the station 5 includes a blocking preventing mechanism 108 that, when the first switching valve 75*a* is closed and flowing between the dust transfer pipe 22 and the secondary dust container is blocked, and the second switching valve 75*b* is open and flowing between the suction passage 61 and the secondary dust container 28 is allowed, prevents closing of the second switching valve 75*b* and secures a predetermined opening degree of the second switching valve 75*b* by operating in conjunction with the first switching valve 75*a* that is blocking flowing between the dust transfer pipe 22 and the secondary dust container 28.

Figure 14:
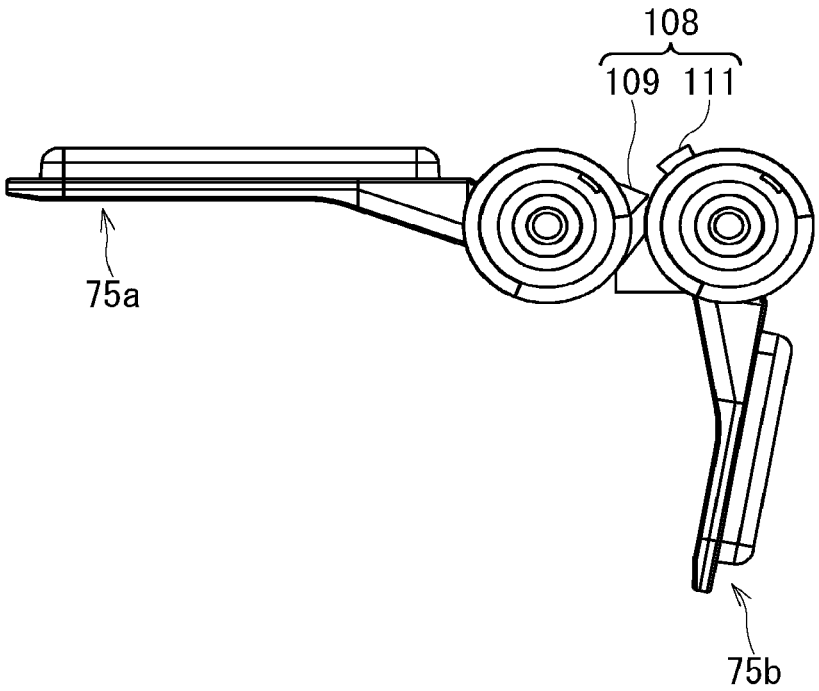
FIG. 14 is a view illustrating a blocking preventing mechanism of the electric vacuum cleaning apparatus according to the embodiment of the present invention.
Figure 15:
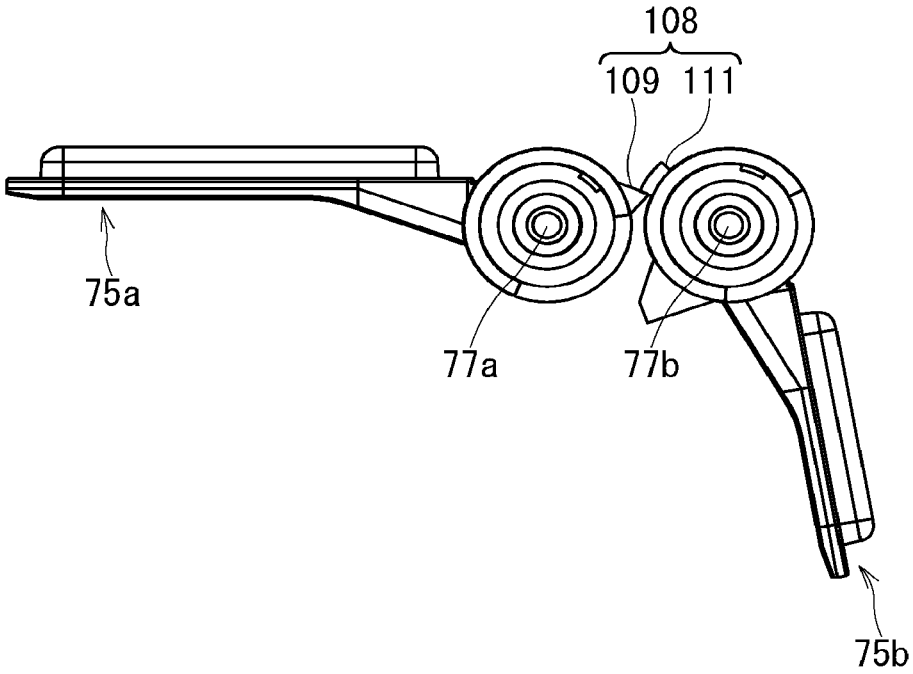
FIG. 15 is a view illustrating the blocking preventing mechanism of the electric vacuum cleaning apparatus according to the embodiment of the present invention.

FIG. 14 and FIG. 15 are views that illustrate the blocking preventing mechanism of the electric vacuum cleaning apparatus according to the embodiment of the present invention.

As illustrated in FIG. 14 and FIG. 15, the blocking preventing mechanism 108 of the electric vacuum cleaning apparatus 1 according to the present embodiment includes a first protrusion 109 that is provided in the first switching valve 75*a*, and a second protrusion 111 that prevents the occurrence of fully closing of the second switching valve 75*b* by catching on the first protrusion 109.

The blocking preventing mechanism 108 is arranged outside the channels. That is, the first protrusion 109 is arranged outside of the dust transfer pipe 22. The first protrusion 109 is provided at one end of the first hinge 77*a* that is arranged outside of the dust transfer pipe 22. The second protrusion 111 is arranged outside of the suction passage 61. The second protrusion 111 is provided at one end of the second hinge 77*b* that is arranged outside of the suction passage 61.

The first protrusion 109 is provided at an end of the first hinge 77*a* that is arranged on the outside of the dust transfer pipe 22, and is integrated with the first valve member 76*a*. The first protrusion 109 moves in the circumferential direction of the first hinge 77*a* to track opening and closing of the first valve member 76*a*.

The second protrusion 111 is provided at an end of the second hinge 77*b* that is arranged on the outside of the suction passage 61, and is integrated with the second valve member 76*b*. The second protrusion 111 moves in the circumferential direction of the second hinge 77*b* to track opening and closing of the second valve member 76*b*.

The first protrusion 109 is a chevron shape. The second protrusion 111 extends in the radial direction of the second hinge 77*b* of the second switching valve 75*b* and has a flat surface that contacts against the first protrusion 109 to prevent the occurrence of a situation where the second switching valve 75*b* fully closes.

Note that as long as the first protrusion 109 has an inclined face that receives the flat surface of the second protrusion 111, the first protrusion 109 need not include an inclined face on the rear side of the chevron shape that does not come in contact with the flat surface of the second protrusion 111. That is, as long as the chevron shape of the first protrusion 109 has an inclined face that receives the flat surface of the second protrusion 111, any arbitrary shape including, for example, a trapezoid and a parallelogram is included in the chevron shape.

FIG. 14 illustrates a state where the first switching valve 75*a* is fully closed, and a state where the second switching valve 75*b* is fully open. And then, the second protrusion 111 of the blocking preventing mechanism 108 does not contact with the first protrusion 109. When the second switching valve 75*b* attempts to close in a state where the first switching valve 75*a* is fully closed as shown in FIG. 15, the flat surface of the second protrusion 111 abuts against the inclined face of the first protrusion 109 and movement of the second switching valve 75*b* is thus prevented. Thereby, full closing of the second switching valve 75*b* is prevented. The opening degree of the second switching valve 75*b* is defined in advance by the arrangement relation between the first protrusion 109 and the second protrusion 111 with respect to the respective hinges. Preferably, the opening degree of the second switching valve 75*b* that the blocking preventing mechanism 108 regulates is set within a range where the second valve member 76*b* does not go to the outside of the second recess 79*b* and is not exposed to a freestream in the suction passage 61.

Note that, if the push button 85 is intentionally operated so as to open the first switching valve 75*a* and close the second switching valve 75*b*, the force that presses the first valve member 76*a* against the first valve seat 78*a* through the first eccentric pin 82*a* of the first switching valve 75*a* disappears. Thus, even in the state where the second protrusion 111 of the blocking preventing mechanism 108 contacts the first protrusion 109 and prevents the opening degree of the first switching valve 75*a*, the inclined face of the first protrusion 109 pushes back the second switching valve 75*b* and rides over the second protrusion 111, and the first switching valve 75*a* opens and the second switching valve 75*b* closes as per the intended operation.

Next, another example of the station 5 of the electric vacuum cleaning apparatus 1 will be described.

Figure 16:
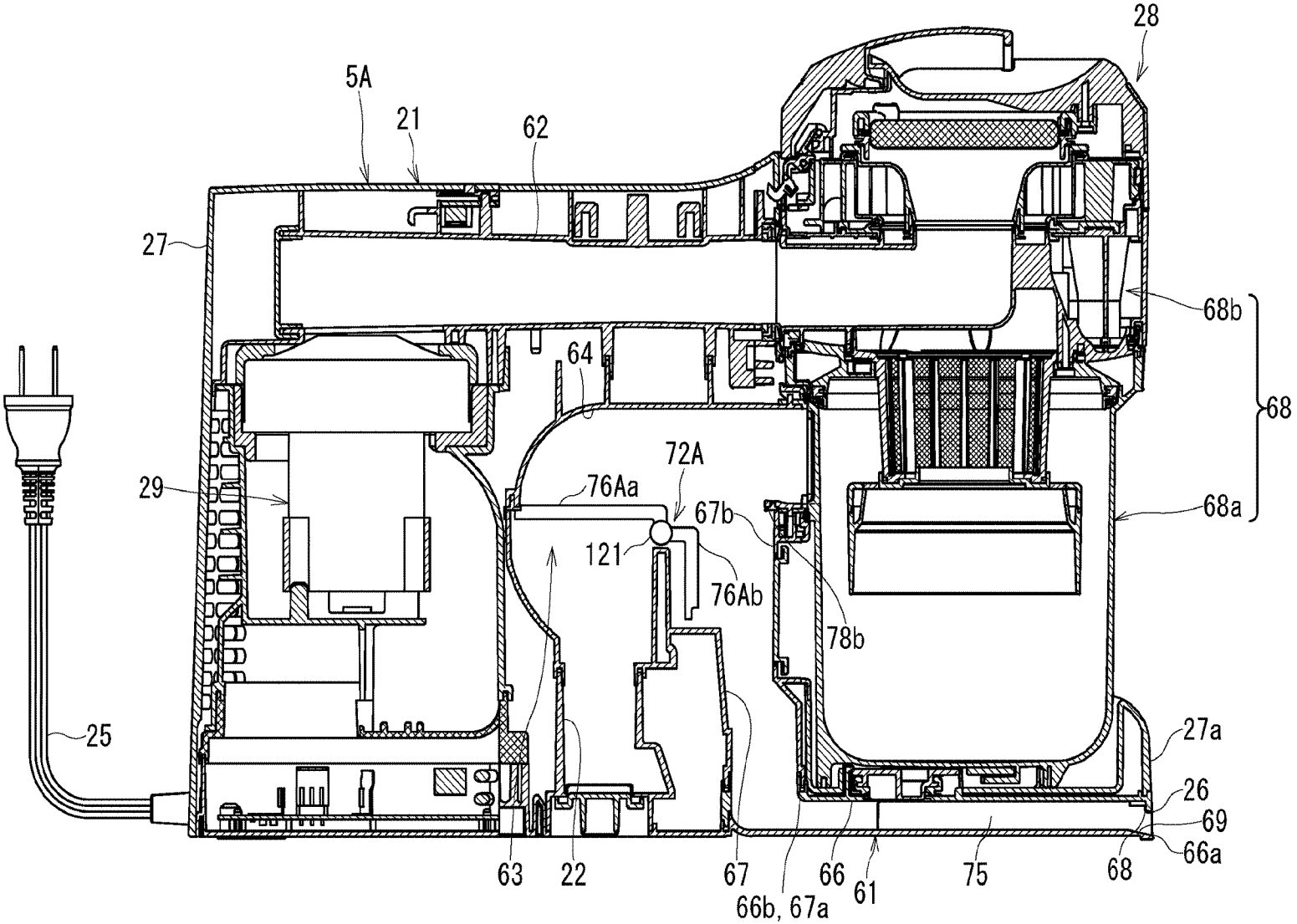
FIG. 16 is a view illustrating another example of the station of the electric vacuum cleaning apparatus according to the embodiment of the present invention.

FIG. 16 is a view that illustrates another example of the station of the electric vacuum cleaning apparatus according to the embodiment of the present invention.

As illustrated in FIG. 16, a station 5A of the electric vacuum cleaning apparatus 1 according to the present embodiment includes a switching valve unit 72A having integrated valve members that switch channels.

The switching valve unit 72A integrally includes a first valve member 76Aa that is capable of allowing or blocking flowing through the dust transfer pipe 22 and a second valve member 76Ab that is capable of allowing or blocking flowing through the suction passage 61, and has a hinge 121 that collectively supports the first valve member 76Aa and the second valve member 76Ab.

Each of the valve members (first valve member 76Aa and second valve member 76Ab) is a quadrangular plate-like body. The valve members (first valve member 76Aa and second valve member 76Ab) each have a valve seat that comes in contact with valve seats (first valve seat 78*a* and second valve seat 78*b*) provided in the junction pipe 64 and block flowing between the respective channels and the junction pipe 64.

The hinge 121 is arranged at a boundary portion or a connecting part between the first valve member 76Aa and the second valve member 76Ab. Thus, the switching valve unit 72A causes the valve members (first valve member 76Aa and second valve member 76Ab) to rotate around the hinge 121 like doors to open and close the channels.

The hinge 121 is arranged on an extension line of a wall that separates the dust transfer pipe 22 and the suction passage 61.

The switching valve unit 72A includes an elastic pressing mechanism (not illustrated in the drawings) that is arranged outside the channels and generates a force that presses the relevant valve member against the corresponding valve seat in a state where the valve member blocks flowing between the relevant channel and the secondary dust container 28, and an eccentric pin (not illustrated in the drawings) that is provided eccentrically with respect to the hinge 121. The pressing mechanism and the eccentric pin are arranged on the outside of the channels.

The electric vacuum cleaning apparatus 1 according to the present embodiment includes the switching valve unit 72 or 72A that is capable of switching a channel that is connected to the secondary dust container 28 so as to allow either one of, and block another of, flowing between the dust transfer pipe 22 (first suction channel) and the secondary dust container 28 and flowing between the suction passage 61 (second suction channel) and the secondary dust container 28. So that, the electric vacuum cleaning apparatus 1 can easily switch between a function that moves dust collected by the autonomous robotic vacuum cleaner 2 to the station 5 or 5A and accumulates the dust at the stations or 5A, and a function that accumulates dust that was swept up at the station 5 or 5A after quickly performing localized cleaning using the cleaning implement other than the autonomous robotic vacuum cleaner 2.

The electric vacuum cleaning apparatus 1 according to the present embodiment includes the separate switching valve unit 72 (first switching valve 75*a* and second switching valve 75*b*). So that, the electric vacuum cleaning apparatus 1 can individually divide the respective channels, and can reliably prevent leaking of air between the channels by means of a simple structure. In particular, the electric vacuum cleaning apparatus 1 can reliably prevent leakage of air around the hinges (first hinge 77*a* and second hinge 77*b*).

The electric vacuum cleaning apparatus 1 according to the present embodiment includes the separate switching valve unit 72 (first switching valve 75*a* and second switching valve 75*b*). So that, the electric vacuum cleaning apparatus 1 is possible to individually manage the dimensional relations between the respective valve members (first valve member 76*a* and second valve member 76*b*) and valve seats (first valve seat 78*a* and second valve seat 78*b*), and can be reliably suppressed the occurrence of an air leakage at a seat surface.

The electric vacuum cleaning apparatus 1 according to the present embodiment includes the switching valve unit 72A that integrally includes the first valve member 76Aa and the second valve member 76Ab. So that, the electric vacuum cleaning apparatus 1 can switch channels with a more simple structure while permitting an air leakage at the periphery of the hinge 121.

The electric vacuum cleaning apparatus 1 according to the present embodiment includes the valve switching mechanism 73 that is capable of switching the switching valve unit 72 and 72A by a one-time operation. So that, the electric vacuum cleaning apparatus 1 provides good operability, enables easy switching of a suction form utilizing the respective channels, and thus can improve convenience.

The electric vacuum cleaning apparatus 1 according to the present embodiment includes the slider 71 that generates a driving force that opens and closes the switching valve unit 72 or 72A by a reciprocating motion. So that, the electric vacuum cleaning apparatus 1 makes assembly simple, and can thus improve the reliability and ensure reliable action of the switching valve unit 72 and 72A.

The electric vacuum cleaning apparatus 1 according to the present embodiment includes the switching valve unit 72 or 72A that is opened and closed by the scotch yoke 89. So that, the electric vacuum cleaning apparatus 1 is possible to open and close the switching valve unit 72 using a simple structure that has few component parts, and the structure can thus contribute to decreasing costs.

The electric vacuum cleaning apparatus 1 according to the present embodiment includes the power source 86 that causes a force to act on the slider 71 so as to actuate the switching valve unit 72 or 72A to enter a state that blocks flowing between the dust transfer pipe 22 (first suction channel) and secondary dust container 28 and allows flowing between the suction passage 61 (second suction channel) and secondary dust container 28. So that, the electric vacuum cleaning apparatus 1 can use a smaller operating force when beginning to suck in dust using the suction passage 61.

The electric vacuum cleaning apparatus 1 according to the present embodiment includes the clutch 87 that holds the switching valve unit 72 or 72A in a state that allows flowing between the dust transfer pipe 22 (first suction channel) and the secondary dust container 28 and blocks flowing between the suction passage 61 (second suction channel) and the secondary dust container 28, and temporarily prevents movement of the slider 71. So that, the electric vacuum cleaning apparatus 1 can improve operability relating to switching of channels when sucking in dust using the suction passage 61.

The electric vacuum cleaning apparatus 1 according to the present embodiment includes the push button 85 that is used for an operation that interlocks with the slider 71. So that, the electric vacuum cleaning apparatus 1 can provide intuitive operability when sucking in dust utilizing the suction passage 61 (second suction channel).

The electric vacuum cleaning apparatus 1 according to the present embodiment can provide a high level of intuitive operability by entering a state where flowing through the dust transfer pipe 22 (first suction channel) is allowed and flowing through the suction passage 61 (second suction channel) is blocked when the push button 85 is in a pressed-down state, and entering a state where flowing through the dust transfer pipe 22 (first suction channel) is blocked and flowing through the suction passage 61 (second suction channel) is allowed when the push button 85 is in a raised state.

The electric vacuum cleaning apparatus 1 according to the present embodiment includes the push button 85 that protrudes by a greater amount from the second body case 27 in a raised state than in a pressed-down state. So that, the electric vacuum cleaning apparatus 1 makes it easy to ascertain the switching state of the channels, and can thus improve convenience.

The electric vacuum cleaning apparatus 1 according to the present embodiment includes the sign 99 that is exposed to outside of the second body case 27 and can be visually recognized when the push button 85 is in a raised state. So that, the electric vacuum cleaning apparatus 1 makes it easier to ascertain the switching state of the channels, and can thus improve convenience.

The electric vacuum cleaning apparatus 1 according to the present embodiment includes the switching valve unit 72 that are opened by the self-weight of the respective valve members. So that, the electric vacuum cleaning apparatus 1 can be reliably opened one of the channels by a channel switching operation.

The electric vacuum cleaning apparatus 1 according to the present embodiment includes the elastic pressing mechanisms (first pressing mechanism 83*a* and second pressing mechanism 83*b*) that generate a force which presses a corresponding valve member (first valve member 76*a* or second valve member 76*b*) against a corresponding valve seat (first valve seat 78*a* or second valve seat 78*b*) in a state where the switching valve unit 72 or 72A is blocking flowing between a channel (dust transfer pipe 22 or suction passage 61) and the secondary dust container 28. So that, the electric vacuum cleaning apparatus 1 can reliably block the relevant channel. Each pressing mechanism also has a function that absorbs a force that acts on the switching valve unit 72 from the valve switching mechanism 73 and does not transfer the force directly to a valve member. And thus, Each pressing mechanism lessens a load that arises between a valve member (first valve member 76*a* or second valve member 76*b*) and a hinge (first hinge 77*a* or second hinge 77*b*) or an eccentric pin (first eccentric pin 82*a* or second eccentric pin).

The electric vacuum cleaning apparatus 1 according to the present embodiment includes the switching detector 101. So that, the electric vacuum cleaning apparatus 1 can operate the secondary electric blower 29 at a good timing in accordance with a switching state of the switching valve unit 72, and thereby improve convenience.

In this connection, in a case where a configuration is applied that has a single valve member that extends across a plurality of channels, a space is necessary where to dispose a valve member that connects both channels as well as a hinge. Such the space can become a leak path that causes air to flow between both channels. Thus, The electric vacuum cleaning apparatus 1 according to the present embodiment includes the first valve member 76*a* and the second valve member 76*b* that are accommodated in the respective channels and are independent from each other. So that, the electric vacuum cleaning apparatus 1 removes unnecessary leak paths from a wall that partitions the channels, and reduces the risk of an air leakage.

The electric vacuum cleaning apparatus 1 according to the present embodiment includes the first recess 79*a* where the first valve member 76*a* is accommodated in a state that allows flowing between the dust transfer pipe 22 (first suction channel) and the secondary dust container 28, and the second recess 79*b* in which the second valve member 76*b* is accommodated in a state that allows flowing between the suction passage 61 (second suction channel) and the secondary dust container 28. So that, the electric vacuum cleaning apparatus 1 can be arranged on the first valve member 76*a* and the second valve member 76*b* an upstream side relative to the respective valve seats. Thus, the valve members are pressed against the valve seats by the suction negative pressure, and thus a risk of leakage at the switching valve unit 72 can be reduced.

Therefore, according to the electric vacuum cleaning apparatus 1 of the present embodiment is possible to easily dispose of dust collected by performing autonomous cleaning by the autonomous robotic vacuum cleaner 2, and also dust that is swept up together after quickly performing localized cleaning using the cleaning implement other than the autonomous robotic vacuum cleaner 2 with effectively utilizing the station 5 that is placed inside the living room.

Further, according to the electric vacuum cleaning apparatus 1 of the present embodiment is possible to easily switch between the function that moves dust collected by the autonomous robotic vacuum cleaner 2 to the station 5 and accumulates the dust at the station 5 to thereby empty the autonomous robotic vacuum cleaner 2, and a function that accumulates dust that was swept up together at the station 5 after quickly performing localized cleaning using the cleaning implement other than the autonomous robotic vacuum cleaner 2, and thus convenience can be improved.

Note that the electric vacuum cleaning apparatus 1 according to the present embodiment may be cleaning apparatus that combines the station 5 and, instead of the autonomous robotic vacuum cleaner 2, a non-autonomous robotic vacuum cleaner (not illustrated in the drawing), for example, an electric vacuum cleaner that a user directly uses to collect dust, such as a canister-type, upright-type, stick-type or handy-type electric vacuum cleaner. The non-autonomous robotic vacuum cleaner may be a cordless type that operates by utilizing a built-in power source such as a battery, or may include a power cord that delivers electric power from a commercial alternating current power source. In this case, the dust transfer pipe 22 functions as an intermediary channel that detachably connects the non-autonomous vacuum cleaner and the secondary dust container 28. That is, according to the electric vacuum cleaning apparatus 1, when an autonomous or non-autonomous electric vacuum cleaner is mounted to the station 5, a state is entered where the primary dust container 12 of the electric vacuum cleaner is connected to the dust transfer pipe 22, and dust collected in the primary dust container 12 can be transferred to the secondary dust container 28 of the station 5.

While certain embodiment has been described, this embodiment has been presented by way of example only, and is not intended to limit the scope of the inventions. Indeed, the novel embodiment described herein may be embodied in a variety of other forms; furthermore, various omissions, substitutions and changes in the form of the embodiment described herein may be made without departing from the spirit of the inventions. The accompanying claims and their equivalents are intended to cover such forms or modifications as would fall within the scope and spirit of the inventions.

What is claimed is:

1. An electric vacuum cleaning apparatus, comprising:

an electric vacuum cleaner that collects dust on a surface to be cleaned; and a station to which the electric vacuum cleaner can be mounted;

wherein the station includes a first suction channel that is connected to the electric vacuum cleaner when the electric vacuum cleaner is returned to the station, and which sucks in dust collected by the electric vacuum cleaner, a second suction channel that sucks in other dust that is different to dust collected by the electric vacuum cleaner, a dust container that is fluidly connected to the first suction channel and the second suction channel, and that accumulates dust that flows in from the first suction channel and the second suction channel, an electric blower that applies a negative pressure to the first suction channel and the second suction channel through the dust container, a switching valve unit that is capable of switching between (1) a first position allowing air flow between the first suction channel and the dust container while blocking air flow between the second suction channel and the dust container and (2) a second position allowing air flow between the second suction channel and the dust container while blocking air flow between the first suction channel and the dust container, and a valve switching mechanism that is capable of switching the switching valve unit between the first position and the second position in one operation, wherein the second suction channel fluidly connects an intake port and the dust container, wherein the intake port includes an opening provided in a lower portion of a side wall of the station to suck in dust that is swept up together with a cleaning implement other than the electric vacuum cleaner, wherein the valve switching mechanism includes a slider that generates a driving force that moves the switching valve unit between the first position and the second position by a reciprocating motion, and wherein the valve switching mechanism includes a scotch yoke that includes first and second guide slots provided in the slider, and first and second eccentric pins provided in the switching valve unit eccentrically positioned with respect to first and second hinges of the switching valve unit, with the first and second eccentric pins arranged in the first and second guide slots, respectively.

2. The electric vacuum cleaning apparatus according to claim 1, wherein the switching valve unit separately and independently includes:

a first switching valve having a first valve member that is capable of allowing or blocking flowing through the first suction channel, and a first hinge that supports the first valve member, and a second switching valve having a second valve member that is capable of allowing or blocking flowing through the second suction channel, and a second hinge that supports the second valve member.

3. The electric vacuum cleaning apparatus according to claim 1, wherein the switching valve unit integrally includes a first valve member that is capable of allowing or blocking flowing through the first suction channel and a second valve member that is capable of allowing or blocking flowing through the second suction channel, and a hinge that collectively supports the first valve member and the second valve member.

4. The electric vacuum cleaning apparatus according to claim 1, further comprising a power source that causes a force to act on the slider so as to actuate the switching valve unit to enter a state in which the switching valve unit blocks flowing between the first suction channel and the dust container and allows flowing between the second suction channel and the dust container.

5. The electric vacuum cleaning apparatus according to claim 1, further comprising a clutch that holds the switching valve unit in the first or second position, and that temporarily restricts movement of the slider.

6. The electric vacuum cleaning apparatus according to claim 1, further comprising a push button that interact with the slider for moving the slider to change between first and second positions of the switching valve unit.

7. The electric vacuum cleaning apparatus according to claim 6, wherein a state where the push button is pressed down is a state where flowing through the first suction channel is allowed and flowing through the second suction channel is blocked, and a state where the push button is not pressed down is a state where flowing through the first suction channel is blocked and flowing through the second suction channel is allowed.

8. The electric vacuum cleaning apparatus according to claim 6, further comprising:

a case having a hole that exposes the push button, wherein an amount by which the push button protrudes from the case is greater in a state in which the push button is not pressed down than in a state in which the push button is pressed down.

9. The electric vacuum cleaning apparatus according to claim 8, wherein the push button includes a sign that is exposed to outside the case and is visually recognizable in a state in which the push button is not pressed down.

10. The electric vacuum cleaning apparatus according to claim 2, wherein the first valve member opens by a weight of the first valve member when a force for closing the first valve member is removed, and the second valve member opens by a weight of the second valve member when a force for closing the second valve member is removed.

11. The electric vacuum cleaning apparatus according to claim 3, further comprising an elastic pressing mechanism that generates a force that presses either the first or second valve member against a respective valve seat when the switching valve unit blocks flowing between the respective channel and the dust container.

12. The electric vacuum cleaning apparatus according to claim 1, further comprising a detector that provides a signal configured to activate driving of a motor of the electric blower when the switching valve unit is placed in the second position.

13. The electric vacuum cleaning apparatus according to claim 12, wherein the detector that detects when the switching valve unit is placed in the second position based on a position of the slider.

14. The electric vacuum cleaning apparatus according to claim 2, wherein:

the first valve member is arranged in the first suction channel, and the second valve member is arranged in the second suction channel.

15. The electric vacuum cleaning apparatus according to claim 2, further comprising:

a first recess that is provided in the first suction channel and in which the first valve member is accommodated when the switching valve unit is placed in the first position, and a second recess that is provided in the second suction channel and in which the second valve member is accommodated when the switching valve unit is placed in the second position.

* * * * *